US005779856A

United States Patent [19]

Kettunen

[11] Patent Number: 5,779,856

[45] Date of Patent: Jul. 14, 1998

[54] COOKING CELLULOSE MATERIAL USING HIGH ALKALI CONCENTRATIONS AND/OR HIGH PH NEAR THE END OF THE COOK

[75] Inventor: Auvo K. Kettunen, Neuvoton, Finland

[73] Assignee: Ahlstrom Machinery Inc., Glens Falls, N.Y.

[21] Appl. No.: 736,112

[22] Filed: Oct. 24, 1996

Related U.S. Application Data

[63] Continuation-in-part of Ser. No. 558,138, Nov. 13, 1995, Pat. No. 5,635,026.

[51] Int. Cl.[6] ..... D21C 11/04

[52] U.S. Cl. ..... 162/34; 162/19; 162/29; 162/33; 162/38; 162/45; 162/49; 162/52

[58] Field of Search ..... 162/17, 19, 29, 162/33, 34, 38, 39, 42, 45, 49, 52, 62, 238, DIG. 10

[56] References Cited

U.S. PATENT DOCUMENTS 5,522,958 6/1996 Li ..... 162/19

*Primary Examiner*—Peter Chin
*Assistant Examiner*—Steven B. Leavitt
*Attorney, Agent, or Firm*—Nixon & Vanderhye P.C.

[57] ABSTRACT

Chemical (typically kraft) pulp having enhanced intrinsic fiber strength and bleachability compared to pulp produced using conventional or modified kraft cooking is produced by using high alkali and/or pH cooking, preferably by adding the vast majority of cooking liquor (such as kraft white liquor) after the first removal of liquid from the digester so that the effective alkali concentration is high near the end of the cook. That is during at least the last minute (preferably at least the last 15 minutes and most preferably at least the last 30 minutes) before the cook is terminated the effective alkali concentration is between 15–50 g/l, more preferably between about 18–40 g/l, and most preferably between about 20–35 g/l. More than 50% (in fact most preferably more than 90%) of the total alkali added to the slurry in order to produce the chemical pulp is added after the first removal of liquid from the digester, and the alkali is added at two or more different locations so that the highest effective alkali concentration is within the range set forth above. The extracted liquors having a high effective alkali concentration are reused in the earlier stages of the cooking to avoid an increase in the addition and consumption of fresh alkali. Also a hydraulic or vapor phase continuous digester is provided with a quench circulation and alkali and heat are added to the quench circulation to control the final kappa number of the pulp, and so that the effective alkali concentration just before termination of the cooking zone is within the above ranges.

21 Claims, 14 Drawing Sheets

234
233
I
260
261
I
262
219
210
265
BLACK
LIQUOR
263
264
II
266
STEAM
267
268
17
CHIPS
11
12
18
237
III
52
51
45
53
40
50
41
13
47
42
WASH
LIQUOR
16
15
43
44
PULP
46
39
FLASH
49
WHITE
LIQUOR
48
38

Fig.8
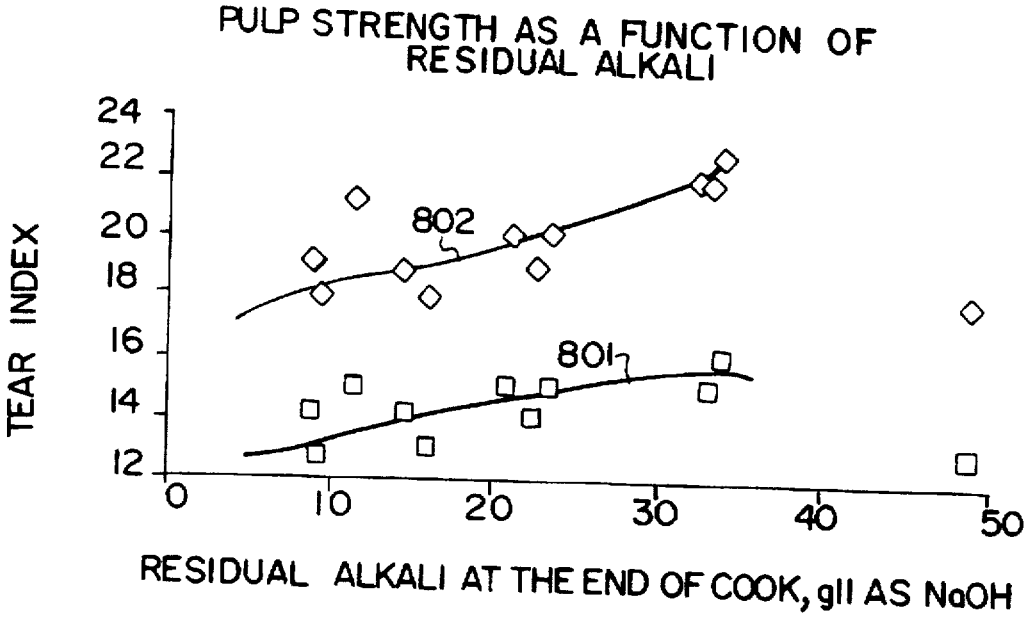
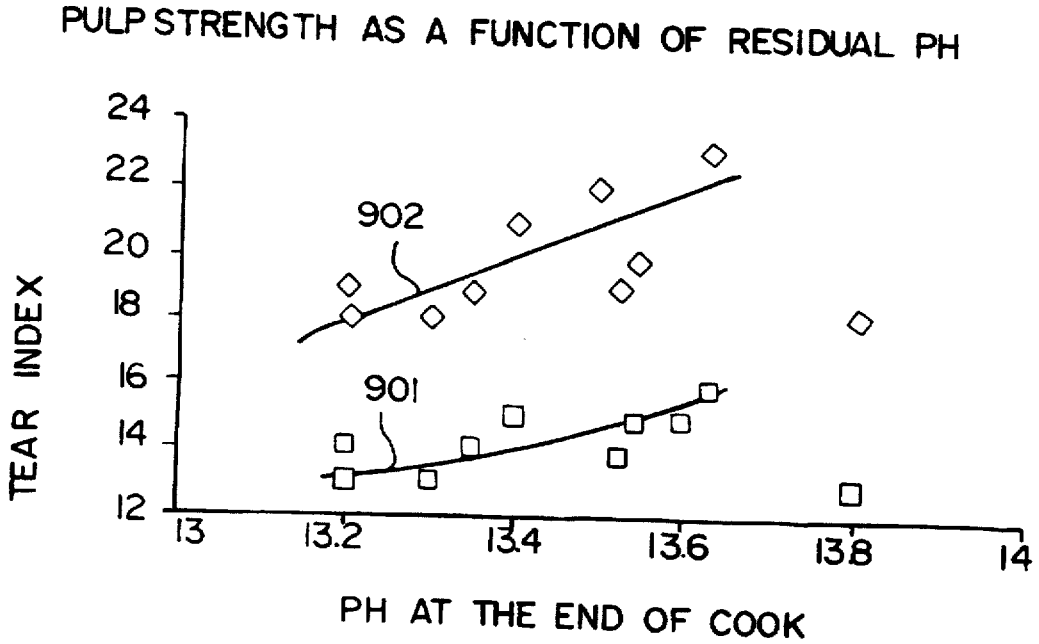
Fig.9

Fig. 10 LO-SOLIDS + COOKING LIQUOR RE-CIRCULATION

COOKING CELLULOSE MATERIAL USING HIGH ALKALI CONCENTRATIONS AND/OR HIGH PH NEAR THE END OF THE COOK

CROSS-REFERENCE TO RELATED APPLICATION

This application is a continuation-in-part of application Ser. No. 08/558,138 filed Nov. 13, 1995 now U.S. Pat. No. 5,635,026.

BACKGROUND AND SUMMARY OF THE INVENTION

The two most important active cooking chemicals used to treat comminuted cellulosic fibrous material during the sulfate or "kraft" cooking process are sodium sulfide, Na2S, and sodium hydroxide, NaOH. An expression used in the pulping industry to designate the amount of cooking chemical present during pulping is "effective alkali". "Effective alkali" concentration describes hydroxide ion (OH) concentration in the cooking liquors. Since sodium sulfide hydrolyzes in an aqueous medium to form sodium hydroxide, or "alkali", and sodium hydrosulfide, the effective alkali of the fresh white liquor is defined as the total of the concentration of sodium hydroxide plus one-half the concentration of sodium sulfide (expressed as NaOH), or $$\text{effective alkali}=[NaOH]+\tfrac{1}{2}[Na_2S]$$

Various methods of treating cellulose material with alkali have been presented. For example, in conventional kraft cooking, all the cooking chemicals, or effective alkali, are introduced at the beginning of the cooking process, that is, before the impregnation phase. In this process the alkali is gradually consumed as the treatment progresses. Typically, the effective alkali in the cooking liquor for a conventional kraft cook is greatest at the beginning of the cook and the least at the end of the cook.

Following studies performed at the Swedish Forest Products Research Institute, STFI, in the early 1980s, so-called "modified cooking" was introduced in the early-to-mid 1980s. As described by Sjoblom, et al. [Paper and Timber, 1983, No. 4, page 227], one of the goals of this type of cooking was to provide a "low and uniform concentration of effective alkali" as a means to improve both viscosity and yield. The variation or profile of the concentration of effective alkali throughout a modified continuous kraft cook was illustrated and contrasted with the variation for conventional kraft cook by Johansson, et al. in 1984 [Svensk Papperstidning, No. 10]. Johansson, et al. described how such modified cooking with more uniform alkali concentrations produced improved pulp viscosity, better bleachability and lower environmental load, among other things. This work and subsequent trials by others established that a low and uniform effective alkali distribution in both continuous and batch kraft cooking was the preferred mode of operation. This low and uniform treatment of pulp became the cornerstone of the MCC® and EMCC® digesters and cooking processes, as sold by Ahlstrom Kamyr of Glens Falls, N.Y., which became very popular in the industry in the late 1980s and early 1990s.

Though the benefits of a low and uniform effective alkali on pulp viscosity and yield have been accepted in the industry, it has been surprisingly discovered that such profiles do not produce pulp having the highest intrinsic fiber strength.

The term "pulp viscosity" had been associated directly with pulp fiber strength. A pulp's viscosity is sometimes interpreted as an indirect measure of the a pulp's relative fiber damage, or depolymerization. The lower the viscosity, according to this reasoning, the more the fiber is damaged. It has often been assumed that a damaged fiber produced a weaker pulp and hence reduced viscosity was interpreted as reduced intrinsic fiber strength. However, it has been found according to the present invention that high effective alkali concentrations and/or high pH during bulk and residual delignification, though possibly reducing a pulp's viscosity, produce a pulp having higher intrinsic fiber strength. For instance, laboratory cooks using high alkali concentrations during cooking.. for example with effective alkali concentrations of 32 g/l required only about 40% of the H-factor as is conventional to produce a kappa number of 21 for softwood and increased pulp strength. Also, cooking in high effective alkali and/or pH yields pulp with better bleachability (as recognized in the literature). Furthermore, the high effective alkali concentration yields a high residual alkali concentration in the spent cooking liquor which can be effectively used to pretreat chips prior to the bulk delignification stage of cooking. The present invention permits the use of lower cooking temperatures and/or shorter cooking times to effect cooks comparable to conventional methods. In other words, by using this invention cooking vessels can be designed smaller and cheaper. This also means that existing cooking vessels, which are limited due to the existing processes, can be made to produce more pulp per unit time without increasing their temperature or effective alkali charge.

The terms "bulk" and "residual", as applied to delignification, are standard concepts in the pulp and paper art, and are defined in "Pulp and Paper Manufacturing", Volume 5, Alkaline Pulping, Grace et al, Technical Section, Canadian Pulp & Paper Association, 1989, pages 60–62. In brief, "bulk delignification" is that phase of delignification during which most of the lignin is removed with a selectivity that is high compared to that during the initial phase that it follows, while "residual delignification" is a phase after bulk delignification characterized by a much slower delignification rate, increased yield loss, and increased alkali consumption per unit of lignin removed.

The exact mechanism that achieves the desired results as set forth above is not completely understood. High pH—which is not identical to high alkali (and may be a more accurate indicator of active cooking chemicals), although high alkali normally creates a condition of high pH—may be more significant than high alkali itself, and the combination of the two may be most significant.

The broadest aspect of this disclosure comprises a method of cooking comminuted cellulosic fibrous material employing high effective alkali concentrations in at least one stage of treatment. This high alkali concentration is preferably practiced in the bulk delignification stage of cooking. Preferably, this effective alkali concentration exceeds 15 g/l (more preferably 20 g/1) during both bulk and residual delignification. The method may be performed continuously or in batch mode, in a single-vessel or multiple-vessel system, in a hydraulic or vapor/liquor-phase digester- in the preferred embodiment, however, the method of the invention is performed continuously, using conventional continuous digesters of a variety of types.

There is also provided a method of treating comminuted cellulosic fibrous material to produce cellulose chemical pulp with enhanced intrinsic fiber strength compared to pulp produced by conventional or modified cooking methods. The method comprises the steps of continuously and sequentially: (a) Treating (e.g. impregnating) the comminuted cellulosic fibrous material with a first cooking liquor having a first effective alkali concentration which is greater than 10 g/l. (b) Further treating the (e.g. now impregnated) material with the first cooking liquor so as to consume alkali from the first cooking liquor, so that the effective alkali concentration of the spent first liquor is reduced to about 10 g/l or less. (c) Extracting the spent first cooking liquor from the material. (d) Treating (e.g. impregnating) the material with a second cooking liquor having a second effective alkali concentration greater than 25 g/l and greater than the first concentration, and a pH of at least 13, the second cooking liquor providing at least 50% of the total alkali to be consumed by the material in the production of chemical pulp. (e) Cooking the material with the second cooking liquor at cooking temperature to produce chemical pulp and a spent second cooking liquor having an effective alkali concentration of greater than about 15 g/l (e.g. greater than about 20 g/1). And (f) extracting the spent second cooking liquor from the pulp.

Step (b) is preferably practiced using as the first cooking liquor the spent second cooking liquor from step (f), some additional cooking liquor (typically white liquor) may be added. In typical existing prior art pulping systems, "conventional" or "modified," the cellulose material must be treated with cooking chemicals to pretreat or impregnate the material prior to formal cooking or bulk delignification. Normally, more than about 25%, sometimes more than 50%, of the total alkali consumed in the production of pulp is consumed during this pretreatment, that is, in step (b). However, among other advantages, the present invention obviates the need to introduce fresh cooking chemical in this pretreatment stage by using the residual alkali present in the black liquor produced in a high-alkali cooking process as the source of cooking chemical in this stage.

In a preferred embodiment of this invention, in order to achieve a high effective alkali concentration in the end of the cook while not increasing the fresh white liquor consumption, at least some of the alkali of the second spent cooking liquor is preferably consumed in step (a) before conveying the spent liquor to recovery. Therefore, the first spent cooking liquor extracted in step (c) and used in step (a) preferably has an EA concentration of between 15–50 g/l (again, as NaOH), typically between 18–40 g/l and preferably between 20–35 g/l. Also, the liquor used in step (a) includes at least some or, preferably, all of the liquor extracted in step (c) Also, due the alkali consumption in step (b) the total alkali charge to step (a) from the spent liquor removed during step (c) should be at least 5%, typically at least 7% and preferably at least 9%, or even at least 11% EA as NaOH on-wood. This alkali charge, from spent cooking liquor, to the stages before stage (c) should be at least 50%, typically at least 70% and preferably at least 90% of the alkali charged to the these stages. Therefore, one or more of the spent liquors removed in step (c) have an total EA charge of at least 5%, typically at least 7%, preferably at least 9%, or even at least 11% as NaOH on wood are re-used and consumed in the stages before step (c) of the cooking process. Some fresh cooking liquor, for example, kraft white or green liquor, may be added to this spent liquor stream to provide the desired EA. This ensures that the EA consumed during steps (d) and (e) is limited so that a relatively high pH and EA are obtained at the latter stage of step (e).

The second cooking liquor of step (d) preferably is white liquor combined with wash liquor, or black liquor, and desirably more than about 80% of the total amount of white liquor (total alkali to be consumed) to be used to produce the pulp should be added in step (d) as the second cooking liquor. Wash liquor is used to dilute the white liquor for the second cooking liquor to provide a desired effective alkali concentration, and a favorable liquor to wood ratio. The practice of step (d) may also inherently result in the heating of the material to cooking temperature, or heating may be practiced separately, cooking temperature typically being in the range of 140°–180° C., typically between 150° and 170° C. Preferably, the liquor present in the digester as the second cooking liquor has an effective alkali of greater than about 25 g/l, e. g. about 25–60 g/l, typically about 30–50 g/l. These ranges of effective alkali concentration are typically provided by diluting the fresh cooking chemically, initially at about 90 g/l or more effective alkali, with any available source of dilution. This dilution may include black liquor, wash filtrate, including bleach plant washer filtrate, or cold blow filtrate, among others. The invention also includes the subsequent steps of cooling and washing the pulp, and prior to step (a) the material is preferably steamed to heat it and remove air from it. Also, steps (a), (b), (d) and (e) may be practiced either co-currently or counter-currently (flow of material to the flow of cooking liquor). The spent liquors extracted in steps (c) and (f) should be kept separately, and used for different purposes, typically the liquor from step (f) being used to preheat the second cooking liquor, and then flashed, with the remaining liquor used as the first cooking liquor while the steam is fed to the chips bin or presteaming vessel for pretreatment of the material. Heat may also be recovered from the liquor from step (c), for example via flashing or a heat exchanger, and then passed to conventional recovery in a kraft mill.

There also is a method of producing chemical pulp having enhanced intrinsic fiber strength from comminuted cellulosic fibrous material, comprising the steps of continuously and sequentially: (a) Treating (e. g. impregnating) the comminuted cellulosic fibrous material with a first cooking liquor having a first pH which is more than about 13.0 (e.g. more than about 13.2). (b) Further treating the (impregnated) material with the first cooking liquor so as to consume alkali from the first cooking liquor, so that the residual pH of the first cooking liquor is about 13.0 or less (or about 13.2 or less). (c) Extracting the spent first cooking liquor from the material. (d) Treating (e. g. impregnating the material with a second cooking liquor having a second pH of about 13.5 or greater (e.g. about 13.7 or greater) and greater than the first pH, the second cooking liquor providing at least 50% of the total alkali to be consumed by the material in the production of chemical pulp. (e) Cooking the material with the second cooking liquor at cooking temperature to produce chemical pulp and a spent second cooking liquor having a residual pH of at least about 13.0 (e.g. about 13.4 or greater or about 13.6 or greater) and (f) extracting the spent second cooking liquor from the pulp.

A kraft pulp with enhanced intrinsic fiber strength and bleachability compared to kraft pulp produced by conventional and modified cooking is also provided. The kraft pulp is produced using one or both of the methods as described above.

According to the invention a method of producing chemical pulp from comminuted cellulosic fibrous material, using a continuous digester having an inlet, is provided. The method comprises the steps of: (a) continuously feeding comminuted cellulose fibrous material in a liquid slurry to the inlet to the continuous digester; and, (b) cooking the material in the digester for more than thirty minutes (e.g. more than about one hour) at a temperature between about 140°–190° C., before the cook is terminated; and wherein step (b) is practiced so that during at least the last minute before the cook is terminated the effective alkali concentration, expressed as NaOH or equivalent, in the digester is at least 15 g/l.

The time and location when and where a "cook is terminated" in a chemical pulping digester is somewhat ambiguous, and is highly dependent upon the cooking equipment used, the process performed and the species of wood processed. A chemical pulping process is generally considered effectively terminated when the material temperature is reduced to about 130°–140° C.; however, some delignification still occurs, though very slowly, at temperatures even as low as about 100° C. However, where and when such a temperature is achieved varies. For example, in continuous digesters having poor distribution of wash liquor or no addition of wash liquor, the pulping reaction may continue even when the pulp has passed out of the formal cooking vessel. In the other extreme, in continuous digesting processes that introduce no cooking chemical to the latter stages of the cooking process and include a Hi-Heat™ counter-current wash zone, the cooking reaction may terminate well above the lowest screen assembly. Though it is not well defined when or where the cooking process is terminated, according to this invention it is desirable that when and where the cook is effectively terminated that the comminuted cellulosic fibrous material contain a relatively high alkali concentration and/or a high pH.

Step (b) is preferably practiced so that during at least the last 15 minutes, and more preferably during at least the last 30 minutes, before the cook is terminated, the effective alkali concentration is between about 15–50 g/l (e.g. between about 18–50 g/l, more preferably between about 18–40 g/l, and most preferably between about 20–35 g/l). Also step (b) is typically practiced by at least at first and second locations removing liquid from the slurry, the first location being closest to the digester inlet; and adding alkali; and wherein more than 50% of the total alkali added to the slurry during the entire practice of steps (a) and (b) is added after the first location. Preferably more than 70% (and more preferably more than 80%, and most preferably more than 90%) of the total alkali added to the slurry during the entire practice of producing a chemical pulp is added after the first location. However the step of adding alkali after the first location is preferably practiced at more than one location, and preferably at more than two different locations, and the alkali is added so that the highest effective alkali concentration during the practice of step (b) is less than 50 g/l, preferably less than 40 g/l, and most preferably less than 35 g/l. Also before the first location at least 5%, preferably at least 7%, even more preferably at least 9%, and most preferably at least 11%, on wood of effective alkali as NaOH has already been consumed by the cellulose material.

According to another aspect of the present invention, a method of producing chemical pulp having enhanced intrinsic fiber strength from comminuted cellulosic fibrous material is provided, which method comprises the steps of continuously and sequentially: (a) Treating the comminuted cellulosic fibrous material with a first cooking liquor having a first effective alkali concentration which is greater than 10 g/l. (b) Further treating the material with the first cooking liquor so as to consume alkali from the first cooking liquor, so that the effective alkali concentration of the spent first liquor is reduced to about 10 g/l or less. (c) Extracting the spent first cooking liquor from the material. (d) Treating the material with a second cooking liquor having a second effective alkali concentration greater than about 25 g/l and greater than the first concentration, the second cooking liquor providing at least 50% of the total alkali to be consumed by the material in the production of chemical pulp. (e) Cooking the material with the second cooking liquor at cooking temperature to produce chemical pulp and a spent second cooking liquor having an effective alkali concentration of greater than about 15 g/l. (f) Extracting the spent second cooking liquor from the pulp; and wherein step (e) is practiced for more than 30 minutes, and wherein during at least the last fifteen minutes the effective alkali concentration expressed as NaOH is between 18°–40 g/l. The same details of the practice of step (e) according to this invention may be practiced as set forth above with respect to the practice of step (c) in the previous embodiment. Also preferably about 80% or more of the total amount of white liquor and total alkali to be used to produce the pulp is added in step (d) as the second cooking liquor. Other details of this method are as described earlier.

Another way to obtain a cooking process having a high effective alkali concentration at the end of the cook, according to this invention, is to modify existing counter-current cooking process (e.g., MCC® or EMCC® cooking as marketed by Ahlstrom Machinery Inc. of Glens Falls, N.Y.) so that the alkali charged to the end of the last counter-current zone is increased significantly. Conventionally, the alkali charged to the end of the last counter-current cooking zone range varies between about 5–20% of the total alkali charged, the total alkali charged is typically about 18–22% EA on-wood. In other words, in conventional methods the alkali charge at the end of the last counter-current cooking zone is typically only about 1–4% EA on-wood as NaOH. The typical EA concentration at the end of the last counter-current cooking zone is about 10–15 g/l. According to the process of the present invention, in order to increase pulp quality, this concentration should be more than 15 g/l, preferably more than 20 g/l and most preferably more than 25 g/l. These high concentrations can be achieved when more than 5%, preferably more than 7% and most preferably more than 9% on-wood of effective alkali is introduced to the end of the last counter-current cooking zone.

According to another aspect of the present invention a hydraulic or vapor phase continuous digester is provided which comprises the following components: A vertical vessel having a slurry inlet, a pulp outlet, a first cooking zone, a second cooking zone and a liquor removal screen, having a circulation, separating the two zones. And, means for adding alkali to the circulation so that the effective alkali concentration expressed as NaOH of the liquor removed by the screen is between about 18–40 g/l. Also the digester preferably further comprises means for adding heat to the circulation too, with the means for adding alkali, to control the final kappa number of the pulp discharged from the pulp outlet. Also the digester further comprises means for reusing liquid withdrawn from the screen in the digester closer to the slurry inlet than the pulp outlet.

The first cooking zone may be a co-current or counter-current cooking zone. The second cooking zone may also be a co-current or counter-current cooking zone, but is preferably a counter-current cooking zone, for example an MCC® or EMCC® cooking zone, or a counter-current washing and cooking zone, for example a Hi-Heat™ wash zone. The liquor circulation typically includes a pump, an indirect steam heater and may include dilution liquor addition. One type of screen and circulation that may be used is commonly referred to as a "quench circulation".

It is the primary object of the present invention to provide enhanced intrinsic fiber strength and enhanced bleachability chemical pulp by cooking with high alkali concentration and/or pH. This and other objects of the invention will become clear from an inspection of the detailed description of the invention, and from the appended claims.

BRIEF DESCRIPTION OF THE DRAWINGS

FIG. 8 is a graphical representation of pulp strength as a function of residual alkali at two different tensiles;

FIG. 9 is a graphical representation of pulp strength as a function of residual pH at two different tensiles;

DETAILED DESCRIPTION OF THE DRAWINGS

Figure 1:
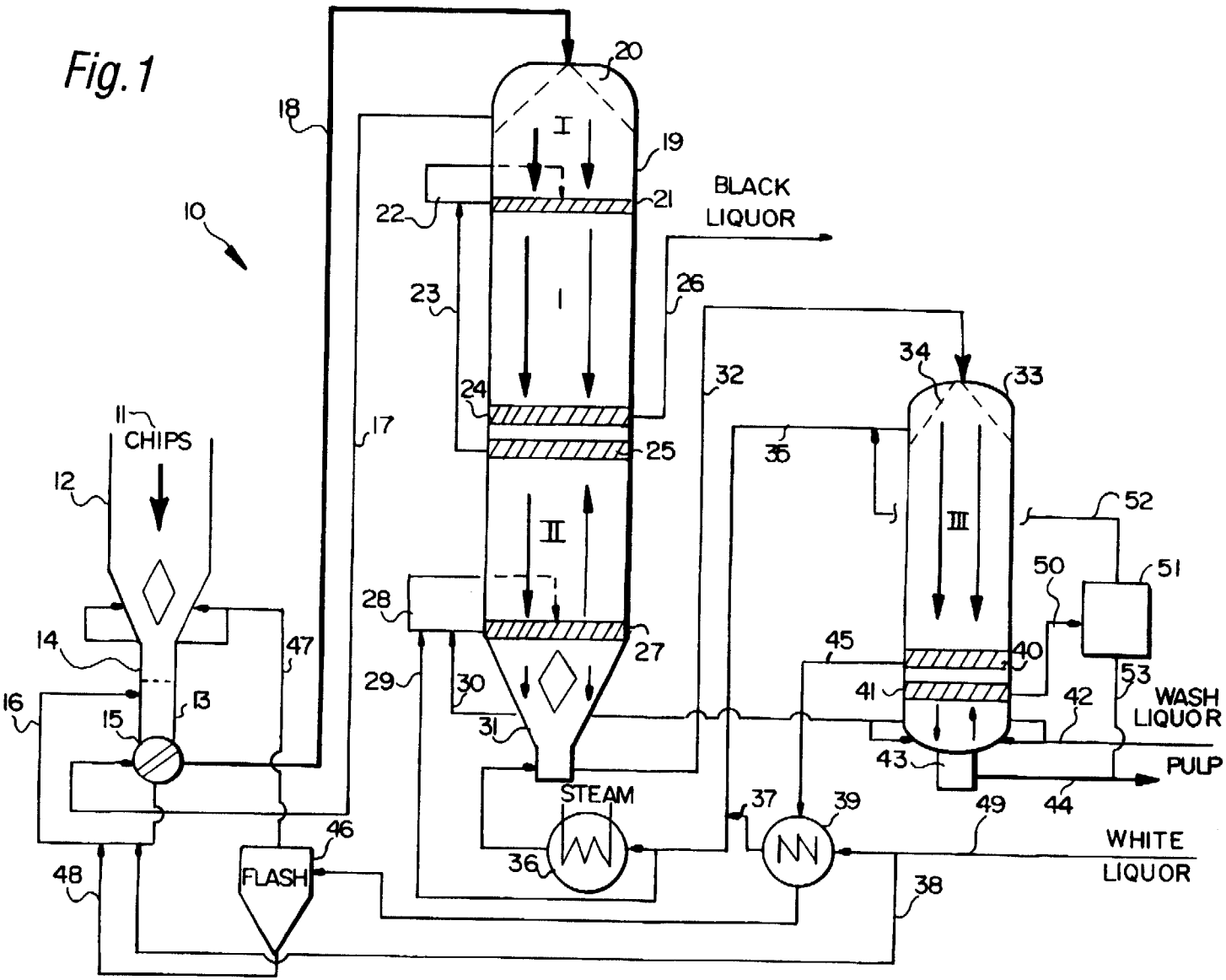
FIG. 1 is a schematic representation of a first embodiment of equipment (new two-vessel digester system) for practicing a method for producing enhanced intrinsic fiber strength chemical pulp.

The disclosed invention can be practiced in conjunction with is other preferred cooking methods to yield a pulping system which produces a pulp having the highest possible strength while making, the most efficient use of the available energy, material and chemicals. Typical pulping systems are disclosed in the drawings.

One typical system that incorporates the benefits of the disclosed invention is shown in FIG. 1. This FIGURE illustrates a typical two-vessel, hydraulic continuous digester system 10 for implementing the process of the invention. Wood chips 11, or other comminuted cellulosic fibrous material, are delivered to a chip bin 12 for presteaming and/or pretreatment. Typically, the bin 12 is a vessel having single convergence and side-relief as described in co-pending U.S. applications Ser. Nos. 08/189,546 filed on Feb. 2, 1994 (10-926) and 08/354,005 filed on Dec. 5, 1994 (10-1020) and sold under the trademark DIAMOND-BACK® by Ahlstrom Machinery Inc. of Glens Falls, N.Y. The steaming process may be performed at atmospheric or superatmospheric pressure. The chips may be introduced to the bin by means of gates as shown in U.S. Pat. No. 4,927,312 or by synchronized gates as shown in pending application 08/350,129 filed on Nov. 11, 1994 (10-1019).

The steamed chips are discharged from the chip bin into a conduit or chute 13 having a level of cooking liquor 14 such that the chips are immersed in cooking liquor and the process of cooking liquor impregnation begins. The discharge from the bin may include a rotary air-lock type feeder (not shown) such as a Chip Meter as sold by Ahlstrom Machinery Inc. The liquor level within the conduit 13 is maintained by conventional level control means (not shown). If desired, the liquid level may be maintained in the chip bin 12 above the conduit or chute 13.

The conduit 13 discharges to a conventional high-pressure feeder 15, also sold by Ahlstrom Machinery Inc. The rotary, pocket-type feeder 15 in conjunction with a high pressure pump (not shown) pressurizes and transports the chip slurry from the low pressure of the feed system to the high pressure of the cooking vessel (e.g. vessel 19). For example, the pressure of the chip slurry may be raised from a pressure ranging form 0 to 30 psi (0–2 bar), to a pressure required for the delignification reaction of 45 to 200 psi (3–14 bar). This feeding system typically includes as conventional components a chip chute pump, in-line drainer, level tank, etc: (all not shown) associated with circulation 16, as is conventional. This pressurization and transport may also be effected by a slurry-type pump as disclosed in co-pending U.S. applications Ser. Nos. 08/267,171 filed on Jun. 16, 1994 (10-961) or 08/428,302 filed on Apr. 25, 1995 (10-1051). During this pressurization and transport the chip slurry is typically exposed to heated cooking liquor, at a temperature of 80° to 120° C., typically 90° to 110° C., by means of circulation 17.

This heated, pressurized transfer of chips and liquor passes the slurry by means of conduit 18 to a top of a cooking vessel 19, for example, an impregnation vessel, pretreatment vessel, or digester. FIG. 1 illustrates a typical impregnation vessel 19 that can be used for this invention. Excess liquor is removed from the slurry by means of screens 20 and returned via conduit 17 to be used to slurry material from the feeder 15. In vessel 19 the chip slurry is exposed to a relatively long, cool co-current impregnation in the zone identified as zone I. This long, cool impregnation is disclosed in co-pending U.S. application Ser. No. 08/460,723 filed on Jun. 2, 1995 (ref. 10-1070), the disclosure of which is included by reference herein. In this long, cool impregnation zone I, which begins when liquor is introduced in high-pressure feeder 15, the chip slurry is typically maintained at a temperature of 80° to 110° C., preferably 90° to 105° C. Though this treatment is shown as a co-current treatment in FIG. 1, it may also be a counter-current treatment.

The impregnation zone I may include a screen 21 and a circulation 22 to aid in the downward movement of chips and to distribute heat and chemicals more uniformly throughout the chip column. This circulation may be provided with a conventional liquor pump and indirect steam heater (not shown). This circulation may also be supplemented by the addition of black liquor, white liquor, or pulp enhancing ingredients, such as polysulfides and anthraquinones and their derivatives. In FIG. 1, this circulation is supplemented via conduit 23 by black liquor removed from a subsequent treatment zone.

After being treated in the impregnation zone, zone I, the slurry typically passes to a counter-current heating zone, zone II. The zones I, II are separated by one or more liquor extraction screens 24 and 25, which via vessel pressure or pumping, remove liquor from the impregnation zone and provide the motive force for drawing liquor up through the counter-current zone II. The withdrawn liquor may be used elsewhere in the cooking process, or may be directed to the liquor and heat recovery system. For example, as shown in FIG. 1, the cooler dilute black liquor withdrawn from the upper screen 24 may be sent to recovery via conduit 26. The hotter liquor withdrawn through screen 25, which may contain usable alkali and sulfide, can be passed via conduit 23 to circulation 22 to increase the alkali and sulfide and to improve temperature distribution in the upper part of zone I. Even if a single screen assembly is used, the liquor, though mixed, may be divided and used as desired.

The hot liquor in conduit 26 may also may be directed to an indirect heat exchanger as disclosed in co-pending U.S. application Ser. No. 08/420,730 filed on Apr. 10, 1995 (10-1054).

The liquor withdrawal via screen 24 effectively terminates the impregnation stage and also removes wood moisture and steam condensate which tend to dilute the concentration of cooking chemicals in the subsequent cooking zones. The entire impregnation stage, from the time the chips encounter liquor at greater than 80° C. to the removal of the cooler liquor by means of the extraction screens may last from thirty minutes to seventy-two hours, but is typically one to six hours in duration, preferably, one to three hours. In the counter-current heating and impregnation zone II, the down-flowing, impregnated chips are heated by means of hotter cooking liquor drawn upward by means of screens 24 and 25. This liquor is typically heated by means of circulation 28 to a temperature of 120° to 160° C., typically 130° to 150° C., preferably 135° to 145° C., This counter-current heating may last from about five minutes to six hours, but typically lasts one-half to three hours. This countercurrent stage is preferred, but other means of heating the slurry may be used, such as one or more co-current heating circulations (using indirect or direct heating methods), the application of external heat to the vessel or flows from the vessel, or the like. Similar to circulation 22, circulation 28 typically includes one or more screens 27, a pump and an indirect steam heater (not shown). The liquor in this circulation may be supplemented by the addition of heated liquor extracted from subsequent cooking stages. The liquor in this circulation may also be supplemented by the addition of cleaner filtrate, with or without the addition of cooking liquor, so that dissolved wood material is displaced from the cooking system. By doing so, this system also employs the LO-SOLIDS™ cooking digester and process, as sold by Ahlstrom Machinery Inc., which is disclosed in co-pending U.S. application Ser. No. 08/056,211 filed on May 4, 1993 (ref: 10846) and WO 94/25668. In the preferred embodiment shown in FIG. 1, both hot black liquor, from the transfer circulation between the two vessels, via conduit 29, and cold blow wash filtrate, via conduit 30, are added to this circulation.

After being heated in the lower part of the impregnation vessel 19, the heated, impregnated slurry is then discharged from the impregnation vessel, heated to cooking temperature and passed to a second cooking vessel, or digester 33. Though the impregnation vessel may utilize a conventional rotating discharge device, the discharge outlet 31 from the first vessel is preferably has geometry exhibiting single-convergence and side-relief in lieu of a rotating mechanical device. This type of outlet is described in co-pending U.S. application Ser. No. 08/401,503 filed on Mar. 10, 1995 (10-1050) and is sold under the trademark DIAMOND-BACK by Ahlstrom Machinery Inc. of Glens Falls, N.Y.

During the discharge from the impregnation vessel, the chip and liquor slurry is exposed to cooking liquor essentially at full cooking temperature, that is, at a temperature between 140° and 180° C., typically between 150° and 170° C. The hot liquor introduced via conduit 35 to the discharge of the vessel 19 "slurries" the material to the top of the digester 33. Excess liquor is then typically removed from the slurry by screen 34 and returned to the outlet 31 by conduit 35. This return liquor circulation 35 is typically heated by steam in a conventional indirect heat exchanger 36. Prior to being introduced to the heat exchanger 36 some of the liquor in this circulation may be removed and introduced to the liquor circulation 28 via conduit 29.

Cooking liquor, typically kraft white liquor, is preferably introduced to the material in circulation 35 by means of conduit 37 upstream of the heater 36. As is characteristic of this invention, preferably a large percentage of the cooking liquor added to this system is added via conduit 37 to circulation 35. Typically, at least 50% of the cooking liquor is added to circulation 35, preferably at least 80% (e. g. about 90%) is added to circulation 35. This produces a very high effective alkali concentration in the digester of greater than twenty five grams per liter, preferably grater than thirty five grams per liter. The balance of the liquor may be added to circulations 16 via conduit 38 or to circulations 22 or 28 in order to ensure a minimum alkali content in these circulations to prevent lignin condensation, acid hydrolysis, etc. The cooking liquor added via conduit 37 may be heated indirectly in a heat exchanger 39 by steam or with hot spent cooking liquor extracted from the digester, for example, from screen 40.

In order to achieve the desired high alkaline and high pH conditions according to the present invention, the cooking liquor (such as kraft white liquor) added via conduit 37 may have the following properties: a total alkali on wood ranging from about 15–25% (typically about 16–22%)—an effective alkali concentration of about 90–130 g/l as NaOH (typically about 100–120 g/1), diluted to the desired ranges of about 25–60 g/l, preferably about 30–50 g/l, before practice of the invention; and a flow of about 2.0–5.0 cubic meters per bone-dry metric ton of pulp ($m^3$/BDMT), typically about 3.0–4.0 $m^3$/BDMT.

The heated slurry with cooking liquor, essentially at cooking temperature, is transferred under pressure from outlet 31 to the top of the vessel, or digester, 33 via conduit 32. Excess liquor is removed via screen assembly 34 in the inlet to the digester and is returned to the impregnation vessel outlet 31 via conduit 35 to slurry the chips. Typically, this returned liquor is steam heated in an indirect heat exchanger 36 prior to being introduced to outlet 31. This heated liquor may be introduced to a several nozzles in the outlet to facilitate uniform discharge of the slurry.

The now fully-impregnated chips, at cooking temperature, pass co-currently downward in the digester 33 in zone III, as the pulping reaction proceeds. Though this treatment is shown as being co-current, it may also be a counter-current treatment. This cooking reaction with high alkali concentration may last from one-half to six hours, but typically only lasts one to three hours. In the lower section of the digester, hot, waste, cooking liquor is removed from the now fully-cooked chips by means of one or more screen assemblies 40 and 41. Cooler wash filtrate from the downstream pulp washers (not shown) may be introduced to the bottom of the digester via one or more conduits 42 to terminate the pulping reaction and to reduce the temperature of the cooked chip slurry.

Wash liquor in conduit 42 may also be added where needed to reduce the concentration of dissolved material in the cook, for example, to circulations 155, 135 or 17. The thus cooled cooked chips are then discharged from the digester via outlet 43 to conduit 44. The cooked pulp is then passed to storage or to subsequent processing such as brownstock washing and bleaching (not shown). If a single screen 40 is used the extracted liquor may be divided and then used as desired.

Again, though conventionally this discharge is aided by a rotating discharge device, discharge may also be accomplished without the aid of a rotating device but by using an outlet geometry exhibiting single-convergence and side-relief Such an outlet is disclosed in pending U.S. application Ser. No. 08/529,41 1 filed Sep. 18, 1995 (ref 10-1124).

As shown in the FIG. 1, preferably, the hot spent cooking liquor is extracted from the digester by means of an upper screen assembly 40 and conduit 45. Since a majority of the effective alkali was introduced to the inlet of the digester, this hot liquor will have a relatively high unused alkali, or "residual alkali", content. The alkali concentration of the liquor in conduit 45 will typically be at least fifteen (e.g. at least twenty) grams per liter and is preferably at least about twenty five grams per liter. The residual alkali content in conventional kraft cooking and modified kraft cooking is typically kept between about six-twelve grams per liter. This lower residual alkali is sought conventionally to ensure that sufficient alkali is present at the point of liquor extraction for a proper cook but at the same time to minimize the waste of alkali that is discharged to the recovery system. The relatively large residual alkali of the present invention results from the preferred high alkali charge introduced to the digester.

However, this alkalinity of this "spent" liquor, though it is not totally spent since it still contains an appreciable alkali content, can advantageously be recirculated to pretreat the wood chips. Note further that the liquor removed via conduit 45 also contains a significant amount of sulfide, typically ten-to thirty grams per liter, that is also advantageous to have during chip pretreatment or impregnation. The ratio of sulfide concentration and effective alkali concentration is higher than in white liquor; therefore the spent cooking liquor has a higher sulfide concentration and/or a higher "sulfidity" so that a higher sulfidity is achieved at the beginning of delignification, when the material is treated with the liquor from conduit 45, than is common in conventional and modified cooks.

The liquor in conduit 45, containing both alkali and sulfide, is preferably passed to circulation 16 of the feed system for use in pretreatment or impregnation of the incoming wood chips. Since the liquor in conduit 45 is typically at cooking temperature, that is 140°–180° C., it may be used as a heating medium in heat exchanger 39 to heat the incoming white liquor in conduit 49. This hot liquor may also be flashed in flash tank 46 to produce a source of steam and to further cool the liquor. The steam may be used via conduit 47 to presteam the chips in chip bin 12. The cooled liquor may be passed to circulation 16 via conduit 48. Instead of flashing, the hot liquor may also be used to indirectly heat water in a heat exchanger to produce a "clean" source of steam.

Also, a second lower screen assembly 41 can be used in the bottom of the digester 33 to extract cooler wash liquor that is drawn counter-currently from the bottom of the digester. The lower part of vessel 33 may include a counter-current heated wash zone (referred to as a HI-HEAT™ wash zone in conventional Kamyr digesters), or a counter-current cooking zone, for example an Ahlstrom Machinery Inc. EMCC® cooking zone in which some cooking chemical is added to the wash liquor to flow counter-currently therewith. The extracted filtrate in conduit 50 will be lower in sulfide concentration due to dilution by the wash filtrate. The filtrate from conduit 50 can be used to pretreat the chips entering the digester by recirculating it the transfer liquor return loop 35 by means of conduit 52. Recirculation via conduit 52 permits control of the effective alkali concentration and liquor-to-wood ratio during the cook. The relatively clean filtrate in conduit 52—which may be supplemented by wash filtrate—also can be used to displace dissolved solids to effect Ahlstrom Machinery Inc.'s LO-SOLIDS™ cooking (e.g. see WO94/25668). Since the liquor in conduit 50 may contain fiber, a fiber filter or screen 51 may be used to remove fiber and return it to the pulp stream via conduit 53.

The weak black liquor in conduit 50 and the strong black liquor in conduit 45 may also be used to implement the two-step liquor impregnation process disclosed in co-pending U.S. applications Ser. Nos. 08/299,103 filed on Sep. 2, 1994 (10-1004)—08/345,822 filed 15 on Nov. 21, 1994 (10-1024); and 08/403,932 filed Mar. 14, 1995 (10-1044). For example, the weak black liquor in conduit 50 may be introduced to circulation 16 or 22 as an initial treatment of chips, and the strong black liquor in conduit 45 may be introduced to circulation 22 or 28 as a second treatment. This sequence may also be reversed such that the strong black liquor treatment precedes the weaker black liquor treatment.

In the system shown in FIG. 1 the long counter-current cooking zones are limited to the pretreatment zones instead of at the end of the cook. Since the wood chip (or other comminuted cellulosic fibrous material) mass is softer at the end of the cook it is more difficult to pass liquor counter-currently through it. By limiting the size of the counter-current zone at the end of the cook the digester will be easier to operate. Conversely, the firmer chip mass of a pretreatment zone permits the passage of countercurrent liquor easier and is thus more easy to operate. This aspect of this invention is particularly significant when it is applied to older, over-loaded digesters which have limited or no counter-current flow at the end of their cook.

Figure 2:
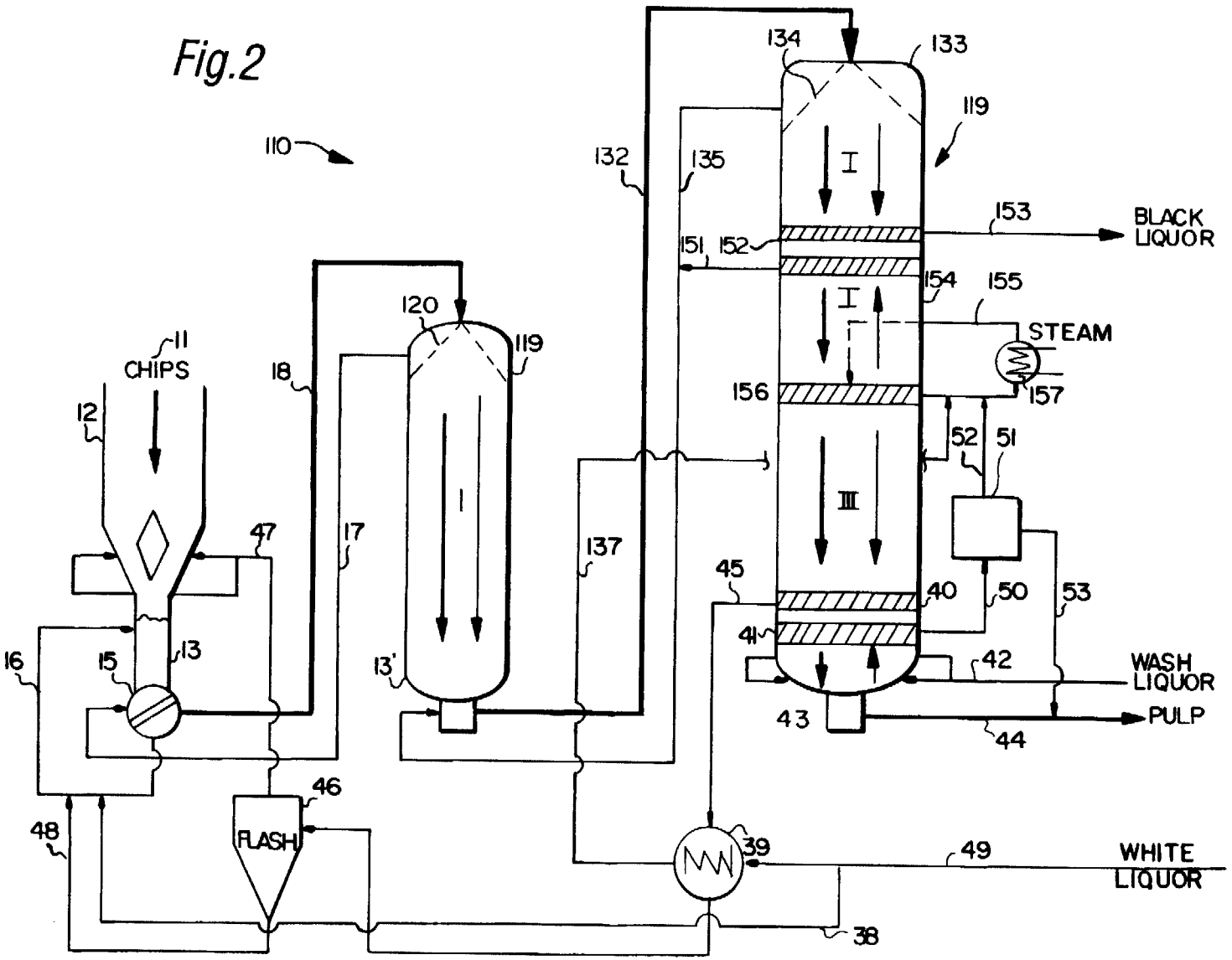
FIG. 2 is a schematic representation of a second embodiment of equipment (preexisting two vessel digester system) for practicing a method for producing enhanced intrinsic fiber strength chemical pulp.

FIG. 2 illustrates the implementation of the processes illustrated in FIG. 1 into an existing two-vessel digester system. Components in FIG. 2 which are identical or have the same function as those in FIG. 1 are identified with the same numbers. Components in FIG. 2 which are unique though similar to those in FIG. 1 are prefaced by the numeral "1".

FIG. 2 illustrates a pulping system 110 with an identical feeding system as is shown in FIG. 1. (Note that the feed system shown includes the novel DIAMONDBACK steaming vessel, this system may also include a conventional feed system including a conventional chip bin and steaming vessel.) After presteaming in vessel 12, the cellulose material is treated with cooking liquor in a long, cool impregnation or pretreatment stage. This treatment, in zone I, is typically at between 80° and 110° C., preferably between 95° and 105° C., for one-half to six hours, preferably, one-three hours. This treatment is done in a first cooking vessel or impregnation vessel, 119, in a co-current treatment mode. This existing vessel typically does not contain any liquor circulations or screens, though it may have circulations and screens. For example, the vessel 119 may include one or more extraction screens creating zones of co-current and countercurrent treatment.

After pretreatment, the impregnated material, at approximately 100° C., is slurried from the conventional outlet 131 of vessel 119 through conduit 132 to the top of a second cooking vessel, or digester, 133. Excess liquor is recovered from the slurry via screens 134 and is returned via conduit 135 to the vessel outlet 131 as the source of slurrying liquid. The liquor in conduit 135 may be supplemented by extracted liquor removed from other parts of the cook, for example, via conduit 151. Therefore the slurry entering the top of digester 133 typically has a temperature of between 110° and 120° C., typically about 115° C.

The pretreatment stage continues in co-current zone I of the digester 133 until the slurry reaches one or more screens 152 and 154. Pretreatment liquor, that is weak black liquor, may be drawn off via screens 152 and directed to recovery via conduit 153. Stronger black liquor drawn up from the counter-current cooking zone, zone II, may be drawn off via screen 151 and added to the recirculation conduit 135 via conduit 151.

The high alkali treatment characteristic of this invention is effected in the counter-current cooking zone II of digester 133. Most of the white liquor, typically at least 50%, preferably at least about 80% (e. g. about 90%) is added to the slurry via circulation 155. This produces a very high effective alkali concentration in the digester of greater than twenty five grams per liter, preferably greater than thirty five grams per liter. The circulation 155 includes one or more screens 156 and a indirect steam heater 157. The cooking liquor, typically kraft white liquor, is added to circulation 155 via conduit 137, and may be preheated in heat exchanger 39 with hot liquor extracted from elsewhere in the digester 119. The heated circulation 155 typically heats the slurry with cooking liquor to cooking temperature, typically 140°–180° C., preferably, 150°–170° C., prior to entering the co-current cooking zone, zone III (which may also include a counter-current cooking zone). The circulation 155 may also include an extraction and the introduction of liquid having lower dissolved organic material to effect Ahlstrom Machinery Inc.'s LO-SOLIDS™ cooking.

The cooking process proceeds in zone III until one or more screens 40 and 41 are encountered. Identical to the processes that were described with respect to FIG. 1, at these screens, the cooking process is terminated and the waste liquors of different chemical make-up are used for pretreatment, chemical recovery and heat recovery.

Though not shown the wash liquor in conduit 42 may also be directed to anywhere in the digester where it can be used to lower the concentration of dissolved material during cooking, for example, to circulations 17, 135 or 155.

Figure 3:
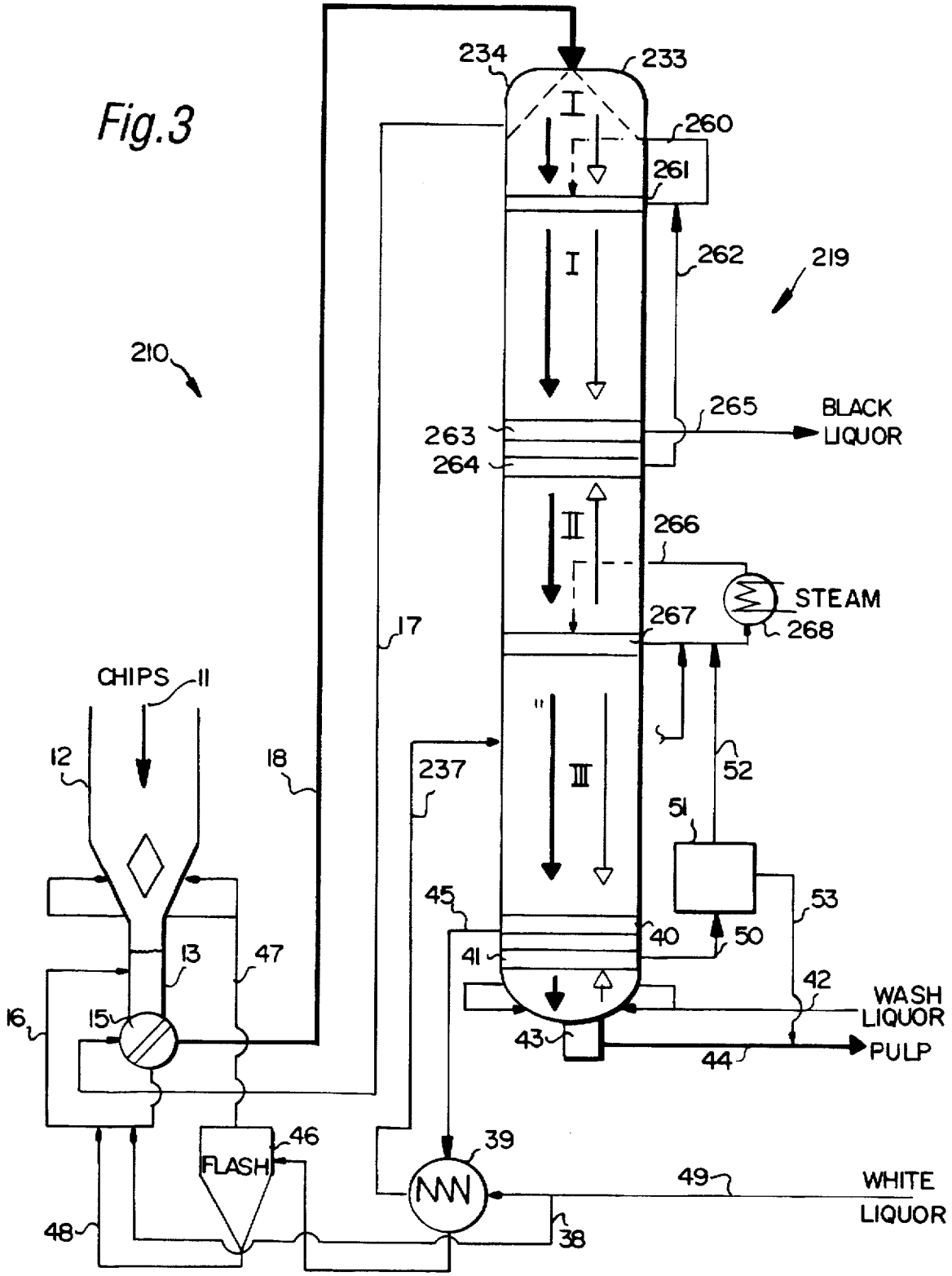
FIG. 3 is a schematic representation of a third embodiment of equipment (existing single vessel digester system) for practicing a method for producing enhanced intrinsic fiber strength chemical pulp.

FIG. 3 illustrates the implementation of the processes practiced utilizing the apparatus illustrated in FIG. 1 into an existing single-vessel digester system. Components in FIG. 3 which are identical or have the same function as those in FIGS. 1 and 2 are identified with the same numbers. Components in FIG. 3 which are unique though similar to those in FIGS. 1 and 2 are prefaced by the numeral "2".

FIG. 3 illustrates a single-vessel pulping system 210 with an identical feeding system as is shown in FIGS. 1 and 2. (Again, note that the feed system shown includes the novel DIAMONDBACK steaming vessel, this system may also include a conventional feed system including a conventional chip bin and steaming vessel.) After presteaming in vessel 12, cooking liquors introduced to the cellulose material and the material is treated in a long, cool impregnation or pretreatment stage. This treatment, identified as zone I, begins in the chute 13 and continues in the transfer conduit 18 and in the upper part 233 of the digester 219. This treatment is typically at between 80° and 110° C., preferably between 95° and 105° C., for about five minutes to six hours, preferably about one-half to three hours. This treatment can typically be performed in a co-current fashion but it may also be a counter-current treatment. Excess liquor is removed from the slurry at the top of the vessel through screen 234 and is recirculated via conduit 17 back to the high-pressure feeder 15 to act as the transfer medium.

The pretreatment zone I may include a liquor circulation 260. Circulation 260 may include one or more screens 261 and a heat exchanger (not shown). The liquor in 260 may be supplemented by adding liquor extracted from other areas in the digester, e.g. via conduit 262. As a result the temperature of the slurry in the pretreatment zone below screen 261 may increase to 110°–120° C., typically to about 115° C.

The pretreatment is effectively terminated at one or more screens 263 and 264 which are located below screen 261. The upper screen, 263, may be used to extract pretreatment liquor form the slurry. This liquor in conduit 265 is typically low in useful treatment chemicals, such as alkali and sulfide, and is typically sent to the recovery system. As before, the liquor in line 265 may also be used to generated steam either by flashing or via an indirect heat exchanger. The liquor removed from the lower screen, 264, typically contains a significant amount of alkali and sulfide and can be recirculated to circulation 260 to pretreat the incoming material.

A counter-current cooking zone, zone II, is located below screen 264. Again, this zone may also be co-current. As is characteristic of the present invention a high concentration of effective alkali is introduced to this cooking zone II via conduit 237. As before, most of the white liquor, typically at least 50%, preferably at least about 80% (e.g. about 90%), is added to the slurry via circulation 266. Again, this produces a very high effective alkali concentration in this cooking zone of greater than twenty five grams per liter, preferably greater than thirty five grams per liter. The circulation 266 includes one or more screens 267 and an indirect steam heater 268. The cooking liquor, typically kraft white liquor, is added to circulation 266 via conduit 237, and may be preheated in heat exchanger 39 with hot liquor extracted from elsewhere in the digester 219. Heated circulation 266 typically heats the slurry with cooking liquor to cooking temperature, typically 140°–180° C., preferably, 150°–170° C., prior to entering the co-current cooking zone, zone III. Again, the cooking time may last from five minutes to six hours, but typically only lasts about one-half to three hours- and LO-SOLIDS™ extraction and dilution may also be provided associated with circulation 266.

As before, the cooking process proceeds in zone III until screens 40 and 41 are encountered. Identical to the processes that were described with respect to FIGS. 1 and 2, at screens 40 and 41 the cooking process is terminated and the waste liquors of different chemical make-up are used for pretreatment, chemical recovery and heat recovery. The wash liquor may be directed as described with respect to the FIG. 2 embodiment.

Figure 4:
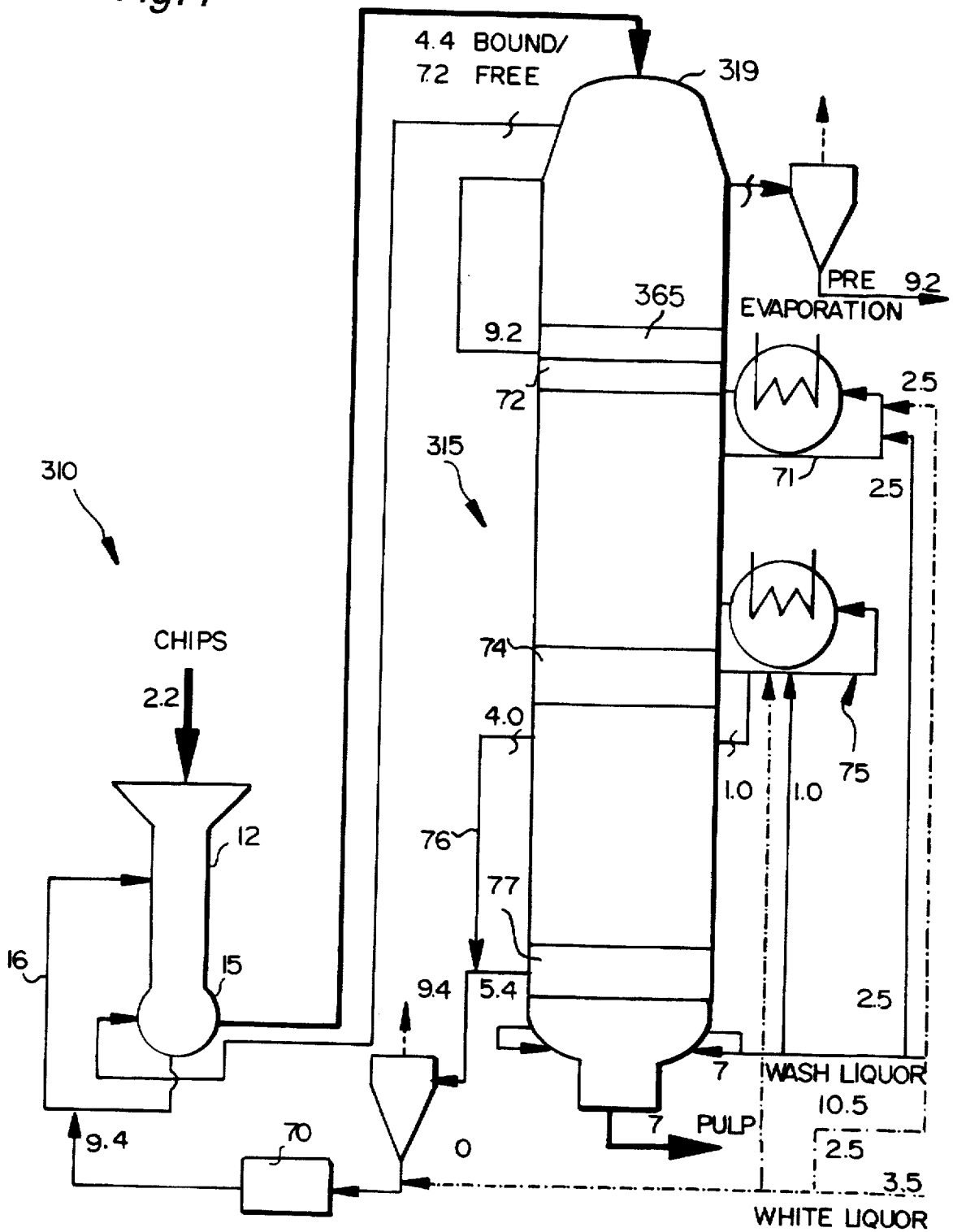
FIG. 4 is a schematic representation of another embodiment of equipment for practicing a method for producing enhanced intrinsic fiber strength chemical pulp.

FIG. 4 is a schematic illustration of another exemplary system that may be utilized according to the present invention. FIG. 4 includes typical bound and free liquor flow volumes (in $m^3$/BDMT) and free liquor flow direction, and illustrates a single vessel hydraulic digester system 310 similar to the system 210 in FIG. 3 (in FIG. 4 components similar to those of the other FIGURES shown by the same two digit reference number preceded by a "3"), for effective high alkali/high pH cooking according to the present invention. In FIG. 4 the numbers are total liquor flow in $m^3$/BDMT; what part of each flow is "bound" or "free" will be described herein. "Bound" liquor is the liquor entrained in the cellulose material, while "free" liquor is the liquor that is not bound but is allowed to pass in and around the cellulose material.

The vessel 12 and feed 15 system in FIG. 4 are the same as those in the other FIGURES, however FIG. 4 utilizes a white liquor cooler 70 which is not used in the other embodiments. The cooler 70 reduces the temperature of the white liquor (which, although shown as "O" in FIG. 4, may be present) and other liquors, such as black liquor entering the feed system, e. g. in line 16. In the example of FIG. 4 about 9.4 $m^3$/BDMT liquor enters the feed system at conduit 16, while 2.2 $m^3$/BDMT enters with the chips, providing a total flow of about 11.6 $m^3$/BDMT. Of this 11.6 $m^3$/BDMT fed to the top of the digester 319, about 4.4 $m^3$/BDMT is bound, and about 7.2 $m^3$/BDMT free. Impregnation continues until liquor is extracted via screen 365. Of the 9.2 $m^3$/BDMT removed via screen 365 about 7.2 $m^3$/BDMT is impregnation liquor while the other about 2.0 $m^3$/BDMT is liquor drawn upwardly from the counter-current section of digester 319 below screen 365. The 4.4 $m^3$/BDMT that is bound when it enters the top of digester 319 continues to be bound throughout passage through the digester 319.

After moving past screen 365, the cellulose material slurry is heated, white liquor is added, and solids displaced in the circulation 71 associated with screen 72. Of the 2.5 $m^3$/BDMT white liquor and 2.5 $m^3$/BDMT wash liquor added to circulation 71, about 2.0 $m^3$/BDMT flows counter-currently and is extracted, and about 3.0 $m^3$/BDMT continues with the cellulose material moving downwardly in digester 319.

The cellulose material in the slurry continues to cook with high alkali and low dissolved solids until screen 74 connected to circulation 75. Black liquor containing high residual alkali and sulfides is extracted in line 76 from circulation 75 (about 4.0 $m^3$/BDMT) and is directed to the feed system. Some of the extracted liquor is replaced by about 1.0 $m^3$/BDMT each of white liquor and wash filtrate. The material continues to be cooked below screen 74 in a counter-current cooking zone, though with less free liquor than before.

The cook is terminated at screen 77 where about 5.4 $m^3$/BDMT of spent liquor is extracted and combined with the extraction from line 76 and directed to the feed system, the liquor (black liquor) being cooled in heat exchanger 70. Cool wash liquor (about 7.0 $m^3$/BDMT) is added to the bottom of the digester 319 and passes counter-currently to the pulp to terminate the cook, cool the pulp, and wash the pulp prior to discharge. Of the about 7.0 $m^3$/BDMT added, about 4.4 $m^3$/BDMT passes upwardly and is extracted via screen 77, while about 2.6 $m^3$/BDMT exits the digester 319 with the approximately 4.4 $m^3$/BDMT bound liquor to produce the approximately 7.0 $m^3$/BDMT of liquor discharged with the pulp as illustrated in FIG. 4.

Figure 5:
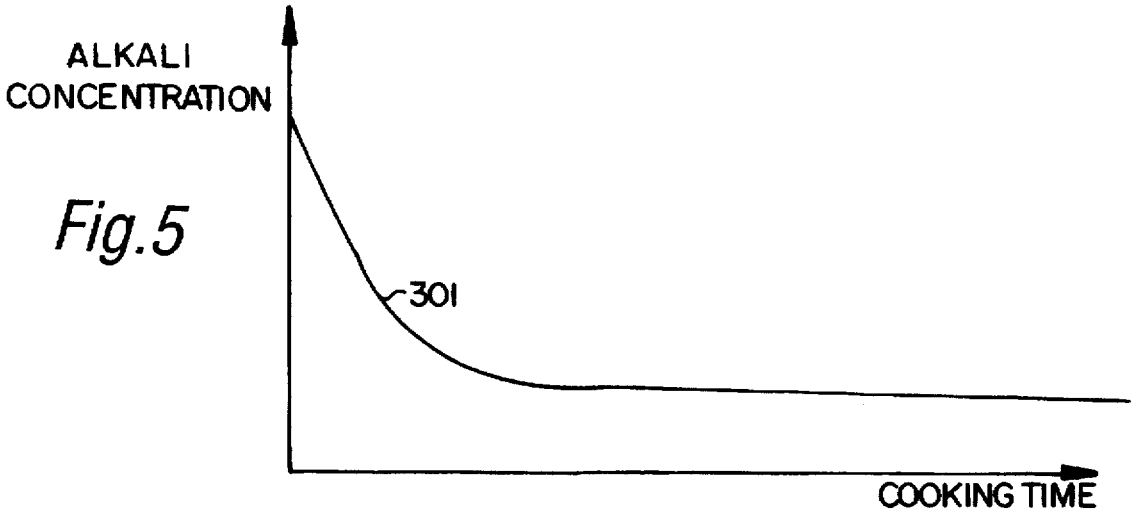
FIG. 5 is a plot of alkali concentration vs cooking time in a conventional cook.
Figure 6:
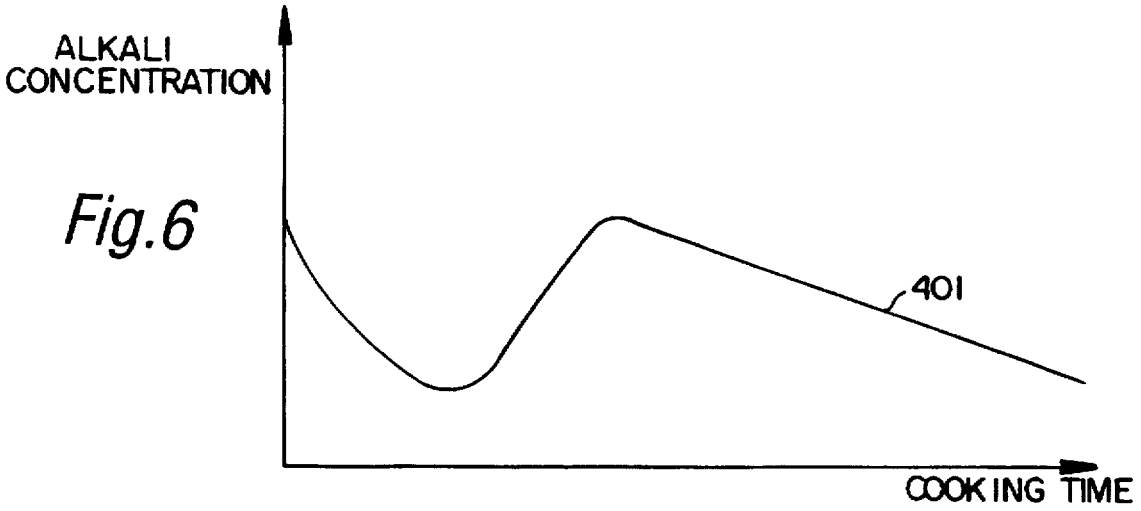
FIG. 6 is a plot of alkali concentration vs cooking time in a modified cook.
Figure 7:
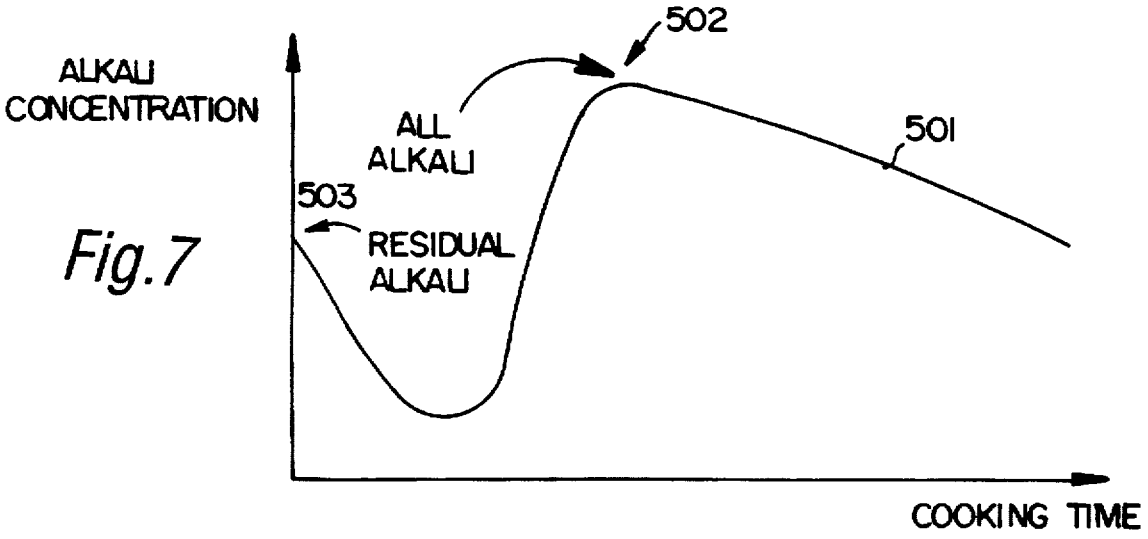
FIG. 7 is a plot of alkali concentration vs cooking time when practicing an exemplary method according to this disclosure.

FIGS. 5–7 illustrate typical alkali concentration variations or profiles throughout a kraft cook for different cooking modes as a function of cooking time. FIG. 5 illustrates the alkali profile for a conventional kraft cook in which all the alkali is added to the feed system prior to impregnation. Curve 301 illustrates how the alkali is greatest at the beginning and decrease continually throughout the cook and achieving a minimum alkali concentration at the end of the cook.

FIG. 6 illustrates a typical alkali profile for a representative modified cook in which about half of the alkali is added at the beginning of the cook and about half is added at the end of impregnation. As shown by curve 401 the alkali concentration peaks at each addition of alkali, but this peak is less than the peak shown in FIG. 5.

FIG. 7 illustrates a typical alkali profile for a kraft cook according to the present invention. All, or substantially all, of the alkali is added after impregnation, at point 502, and the residual alkali present in the liquor after cooking is recirculated to the pretreatment at the start of the cook, point 503. As shown by curve 501, the residual alkali recirculation cause a moderate peak in alkali at the beginning of the cook, point 503, but a higher peak occurs at the point where all the alkali is added, point 502. According to the present invention it has been found that an alkali profile as shown in FIG. 7 produces chemical pulp having higher intrinsic fiber strength and better bleachability than pulp produced by the modified or conventional cooking methods of FIGS. 5 and 6.

FIGS. 8 and 9 graphically illustrate test data which shows the effect of residual alkali and high pH (i.e. preferably about 13.4 or above, typically about 13.6 or above) at the end of laboratory cooks. FIG. 8 shows how the tear index (an indication of intrinsic fiber strength) increases as the concentration of residual alkali increases at the end of the cook (the alkali is expressed as grams per liter of NaOH in FIG. 8), tear indices at seventy (curve 801) and ninety (curve 802) tensile strength being shown. FIG. 9 shows a similar trend of tear index value plotted versus residual pH using the same liquor used in FIG. 8, curve 901 at seventy tensile, and curve 902 at ninety tensile. FIGS. 8 and 9 thus clearly illustrate that intrinsic fiber strength of pulp increases as the residual alkali and/or residual pH increases.

Note that the pH and alkali concentrations shown in FIGS. 8 and 9 are those present in laboratory batch cooks. Actual in-mill conditions, such as the presence of dissolved salts and other materials in the liquor, will usually reduce both the pH and residual alkali actually measured in the mills to values lower than those shown.

Figure 10:
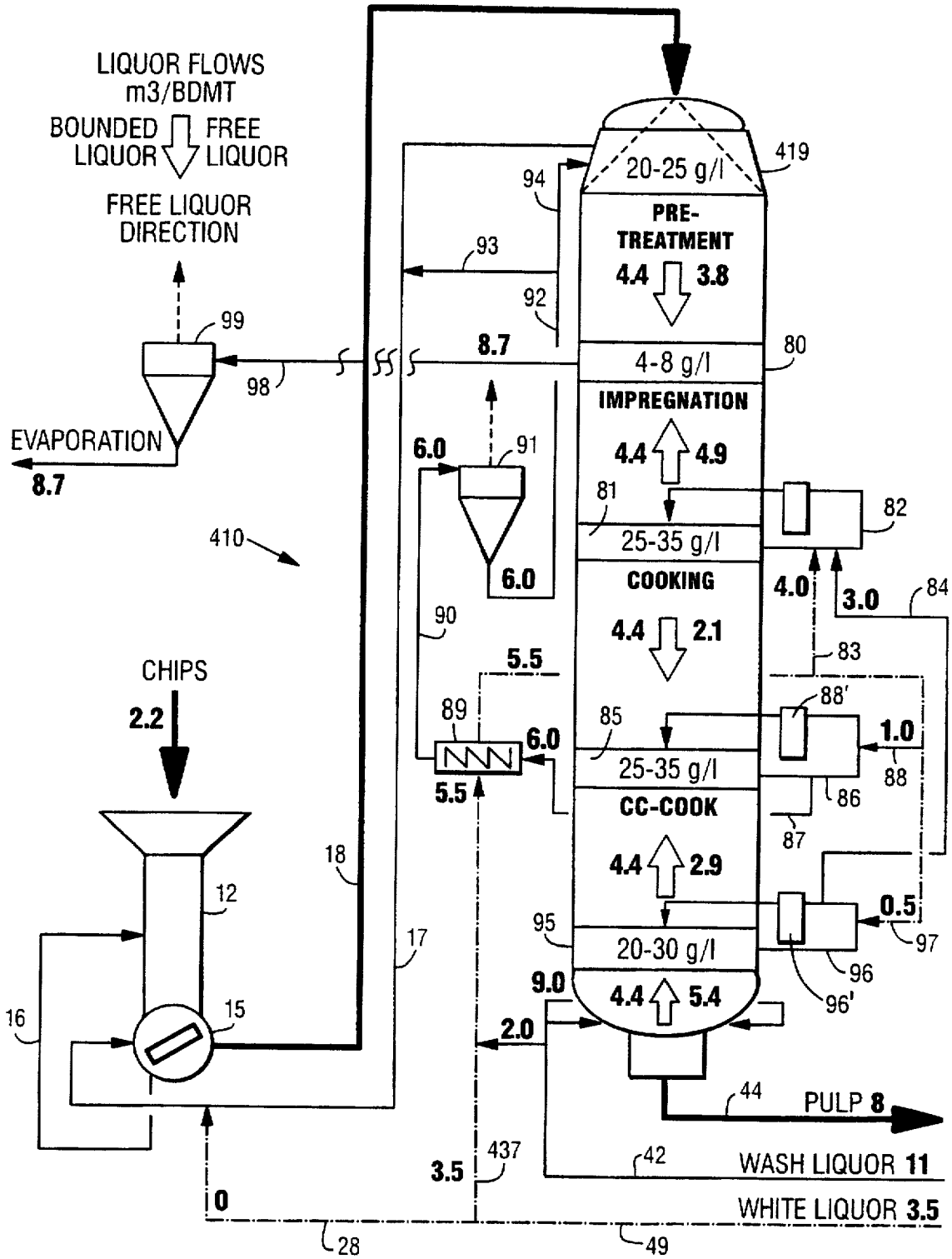
FIG. 10 is a schematic view of an exemplary digester system according to the present invention for practicing a method according to the present invention.

An exemplary digester system for practicing the invention is illustrated schematically in FIG. 10. Similar to FIGS. 3 and 4, FIG. 10 illustrates a single vessel digester system 410 which employs the present invention. This digester may be a new digester designed to practice this invention or an existing digester modified to practice this invention. Though a single-vessel hydraulic digester is illustrated, it is to be understood that a multiple-vessel system or a dual, vapor/liquor phase digester may also be used. One distinction between the digester shown in FIG. 10 and those shown in FIGS. 3 and 4 is that that the digester shown in FIG. 10 includes a counter-current cooking zone toward the bottom of the digester, for example a Hi-Heat™ or EMCC® cooking zone. The system 410 employs the same feed system, 12, 15, 16, 17, and 18 as disclosed earlier. This system also identifies the approximate "bound" and "free" liquor flows discussed with reference to FIG. 4. These liquor flows, as well as those discussed below, are approximate. Actual flow rates will vary depending upon the equipment used, the species treated, and the production rate, among other things. The chips entering the feed system typically contain 2.2 cubic meters of bound liquid per bone-dry metric ton (BDMT) of pulp produced within the cellulose material, typically hardwood or softwood chips. Structures similar or identical to those disclosed in earlier figures are identified with similar numerals though prefixed with a "4".

As shown earlier, the feed system passes a slurry of chips and liquor to the inlet of digester 419. The digester 419 has four screen assemblies, 80, 81, 85, and 95, not including the upper screen assembly from which return flow 17 to the HPF 15 is taken. Little or no cooking liquor, that is, kraft white liquor, need be added via conduit 38 to circulation 17. Again, most if not all of the cooking liquor, that is, 3.5 $m^3$/BDMT in one example, is added via conduits 49 and 437 to downstream cooking zones. In a preferred embodiment of this invention, the cooking chemical, that is, the effective alkali (EA—always expressed as NaOH or equivalent), is typically supplied to the slurry entering the vessel 419 by introducing spent cooking chemical having residual EA content from a downstream cooking process. This spent liquor, for example, kraft black liquor, is introduced for example to conduit 17 via conduit 93, to the top of the digester 419 via conduit 94, or to any other appropriate location in the feed system, for example, to circulation 16 or to a chip chute 13 or the chip bin 12 of FIG. 3.

The slurry enters the digester 419 and excess liquor is extracted via the screen and conduit 17 and returned to the HPF 15. The thickened slurry than passes downward in a first, "Pre-treatment" zone. This slurry typically contains approximately 4.4 $m^3$/BDMT of liquor bound within the cellulose material and 3.8 $m^3$/BDMT of free liquor. In the pre-treatment zone, the free liquor moves in the same direction as the chips, that is, the treatment is "co-current". The slurry enters this zone having an EA of approximately 20–25 g/l as NaOH. The temperature of the slurry in this zone is approximately 80°–130° C. and the treatment time varies from 0.1 to 4 hours, e.g. 0.5–2 hours.

The pre-treatment zone effectively ends when the slurry encounters one or more screens 80. The slurry continues past screen 80 to a second, "Impregnation" zone. In this zone the liquor passes in a direction opposite the flow of chips, that is, the treatment is "counter-current". Liquor from both the upper Pre-treatment zone and the lower Impregnation zone is removed, or extracted, via screen 80 into conduit 98. The EA content of the combined liquors extracted from screen 80 is approximately 2–10 g/l. The relatively weak spent liquor in conduit 98 is typically forwarded to the chemical recovery area of the pulp mill, for example to evaporation, but it may first be flashed, for example, in flash tank 99 to produce a source of steam or passed to a heat exchanger to heat another liquid stream in the mill. This weak liquor stream may also be used for pre-treatment of the incoming chips, for example, in chip chute 13 or chip bin 12 of FIG. 3.

The impregnation zone includes a heated circulation 82 which removes liquor from the end of the zone via one or more screens 81 by means of a pump (not shown). Cooking liquor and spent cooking liquor are typically added to this circulation. For example, kraft white liquor (diluted with wash liquor) is added via conduit 83 in the approximately is amount of 4.0 $m^3$/BDMT and having an EA of about 50–100 g/l. Spent cooking liquor, preferably liquor removed from a downstream cooking process and having an EA of about 20–40 g/l is added via conduit 84 in the approximate amount of 3.0 $m^3$/BDMT. The combined effect of the addition of fresh cooking liquor and spent cooking liquor to circulation 82 yields an EA in the vicinity of screen 81 of approximately 20–30 g/l. Approximately 4.9 $m^3$/BDMT of the liquor added via circulation 82 passes counter-currently through the impregnation zone and is removed in the combined flow of approximately 8.7 $m^3$/BDMT which is extracted via screen 80. The temperature of the slurry in this impregnation zone is between approximately 100°–170° C. and the treatment time varies from 0.1 to 2 hours. The saturated chips in the slurry still typically contain approximately 4.4 $m^3$/BDMT of bound liquid.

The slurry is effectively heated to a cooking temperature of 140°–180° C. (280°–360° F.) by the heated circulation 82 and, after passing screen 81, the slurry enters the "cooking" zone. In the cooking zone the approximately 2.1 $m^3$/BDMT of free liquor passes co-currently with the chips, which again typically contain 4.4 $m^3$/BDMT of bound liquid. In this zone the chips are co-currently cooked in the presence of the fresh cooking liquor and spent cooking liquor added by circulation 82. The treatment time in the cooking zone varies from 0.1 to 4 hours, and preferably is more than thirty minutes. The co-current cooking zone effectively ends when the slurry reaches one or more screens 85. Below screen 85 the slurry enters a counter-current cook zone. Spent cooking liquor from the co-current cook zone and the counter-current cook zone is removed via screen 85. At least some of the liquor removed via screen 85 is pumped by a pump (not shown), heated, and recirculated via circulation 86 to the vicinity of the screen 85.

One significant feature of the invention is that some of the spent liquor removed via screen 85 is removed from conduit 86 via conduit 87 and used for pretreatment in an earlier cooking stage. Preferably, the spent liquor, having an approximate EA of 25–35 g/l (although it may be in the range of 10–60 g/l) is recirculated via conduits 87, 90, 92, and 94 (or 93) to the beginning of the pre-treatment stage. This hot liquor can also be used to heat other liquors or to generate steam; for example, the hot spent liquor in conduit 87 may be passed through a heat exchanger 89 to heat cooking liquor introduced via conduit 437, or any other liquid stream requiring heating. Also, steam can be generated from this hot liquor by passing it via conduit 90 to flash tank 91.

In the counter-current cook zone, the chips—again containing approximately 4.4 $m^3$/BDMT of bound liquor—pass counter-currently to approximately 2.9 $m^3$/BDMT of free liquor. The counter-current cooking zone effectively extends to the one or more screens 95. This free liquor is introduced via the circulation 96, associated with screen 95, and via the wash liquor 42 introduced to the bottom of digester 419. The temperature of the slurry in the counter-current cooking zone is approximately 140°–180° C. and the treatment time varies from 0.1 to 6 hours, and preferably is more than thirty minutes. As in circulations 82 and 86, circulation 96 removes spent cooking liquor via screen 95 by means of a pump (not shown) and re-introduces at least some of the liquor to the vicinity of screen 95, after heating. As discussed above, one feature of this invention is that some of the spent liquor removed via screen 95 is re-circulated via conduit 84 to an earlier cooking stage, in this case to cooking circulation 82. The liquor removed via screen 95 typically has an EA of about 20–30 g/l. Also, some cooking liquor, typically approximately 0.5 $m^3$/BDMT, is added to this circulation via conduit 97.

Below the screen 95 the cooking process is effectively terminated by the addition of wash filtrate, also known as "cold blow" filtrate, via conduit 42 and two or more nozzles located in the lower head of digester 419. Typically, approximately 9.0 $m^3$/BDMT of filtrate is added to the bottom of the digester to terminate the cook and cool the pulp prior to discharge. Also, 2.0 $m^3$/BDMT of this filtrate is typically added to the white liquor supply conduit 437 to dilute the white liquor supply in order to implement LO-SOLIDS™ cooking as marketed by Ahlstrom Machinery Inc. and described in U.S. Pat. Nos. 5,489,363 and 5,547,012. The cooled pulp is discharged from digester 419 into conduit containing 8.0 $m^3$/BDMT of free and bound liquor, that is, at approximately 10–12% bone-dry consistency.

Thus using the digester 419, which may be an hydraulic or vapor phase continuous digester, one continuously feeds comminuted cellulose fibrous material and liquid slurry to the inlet at the top of the digester 419 and the material is cooked in the digester 419 typically for more than an hour at a temperature between about 140°–190° C. before the cook is terminated as described above. The cooking is practiced so that during at least the last minute (and preferably at least the last fifteen minutes, and most preferably at least the last thirty minutes) before the cook is terminated the effective alkali concentration (expressed as NaOH or equivalent) in the digester is at least 15 g/l, that is typically between 15–50 g/l, preferably between about 18–40 g/l, and most preferably between about 20–35 g/l. Also at least at the first location (screen 80) and a second location (screen 85, and preferably also at a third location, screen 95, or more locations) with the first location (screen 80) closest to the digester inlet, liquid is removed from the slurry and alkali may be added. More than 50% of the total alkali added to the slurry during the entire treatment of the wood chips to produce the chemical pulp is added to the slurry after the first location 80, desirably more than 70%, more desirably more than 80%, and most desirably more than 90%. The alkali is preferably added, as indicated in FIG. 10, at more than one, and preferably more than two, locations, such as in the lines 83, 88, 97 in FIG. 10. The alkali is added at a number of different locations and in such a manner as to get a high but uniform alkali profile over the cooking stage, so that the alkali addition is preferably practiced so that the highest effective alkali concentration during the cook is less than 50 g/l, preferably less than 40 g/l, and most preferably less than 35 g/l. Before the alkali addition after the first location (screen 80) at least 5%, preferably more than 7%, even more preferably more than 9%, and most preferably more than 11%, effective alkali as NaOH on wood has already been consumed by the wood chips.

In the digester 419 the circulations 86 and 96 and conduits 88 and 97 and appropriate other conventional equipment provides means for adding alkali to circulations 86 and 96 so that the effective alkali concentration expressed as NaOH in the cooking zone just before the termination of the cook (that is, by decreasing the temperature by introduction of "cold blow" filtrate via conduit 42, etc.) is between 15–50 g/l, preferably between about 18–40 g/l, and most preferably between 20–35 g/l. Also there may be means for adding heat to circulation 86 and 96, such as a conventional indirect heater 96', and 88' or any other suitable conventional liquid heating means utilizable in a circulation. The heat addition at 88' or 96' combined with the alkali addition at 88 or 97, control the final kappa number of the pulp discharged from the pulp outlet 44 with much shorter control feedback delay than if the kappa number were controlled by the temperature in the circulation 82, as is done conventionally. The screen 95 is associated with circulation 96 and means are provided, such as conduit 84 and any other suitable conventional components, for reusing liquid withdrawn from the screen in the digester closer to the slurry inlet at the top of the digester 419 than the pulp outlet 44. By doing so the temperature in the bottom of the digester can be more accurately controlled, for example, by using a high counter-current flow (i.e. a higher "dilution factor") in the zone above screen 95, the temperature of the pulp can be lowered sharply to terminate the cook. If the digester cannot sustain a positive dilution factor between screens 85 and 95, the temperature of the pulp and the termination of the cook can be better controlled by using one or both of these circulations, 86 and 96. (The dilution factor is a measure of the displacement of liquor by wash water. A positive dilution factor indicates that wash liquid in excess of what is required for total displacement of the liquid in the pulp is applied. A negative dilution factor indicates that total displacement of the liquid in the pulp did not occur.)

The system disclosed in FIG. 10 illustrates one preferred method and apparatus for practicing the present invention. Specifically, by introducing most, if not essentially all, of the fresh cooking chemical to a later stage of a cooking process and selectively recirculating at least some of the alkali-containing spent cooking liquor to an earlier treatment or cooking stage a preferred high-alkali profile is obtained in the cooking process. As illustrated by the lab- and millscale data presented in FIGS. 11–13 and 15–17, respectively, this high-alkali profile produces a cellulose pulp having high strength and brightness and reduced reject content.

Figure 11:
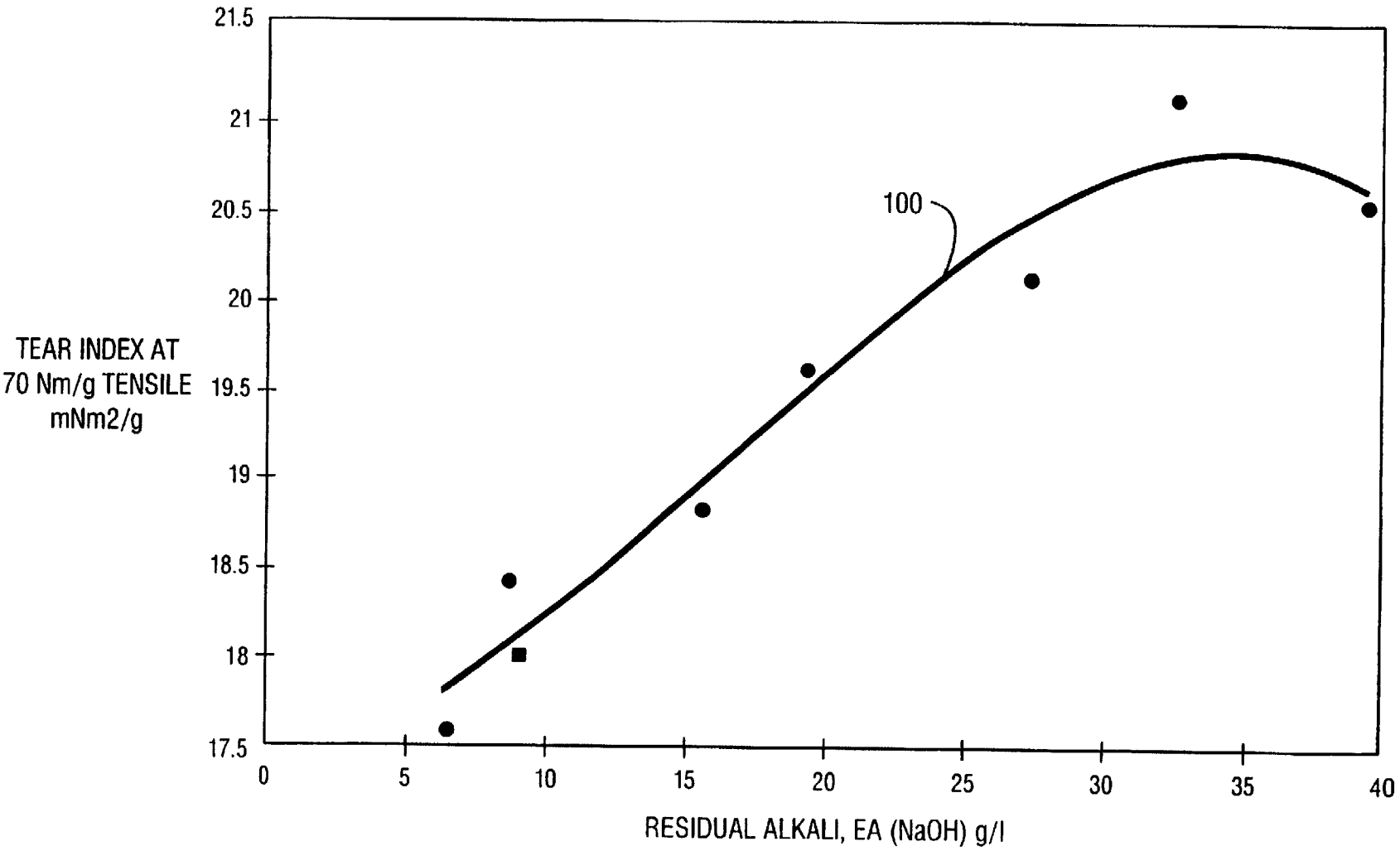
FIGS. 11 through 13 are graphical representations of the effect of residual effective alkali concentration on pulp properties when practicing the invention.
Figure 12:
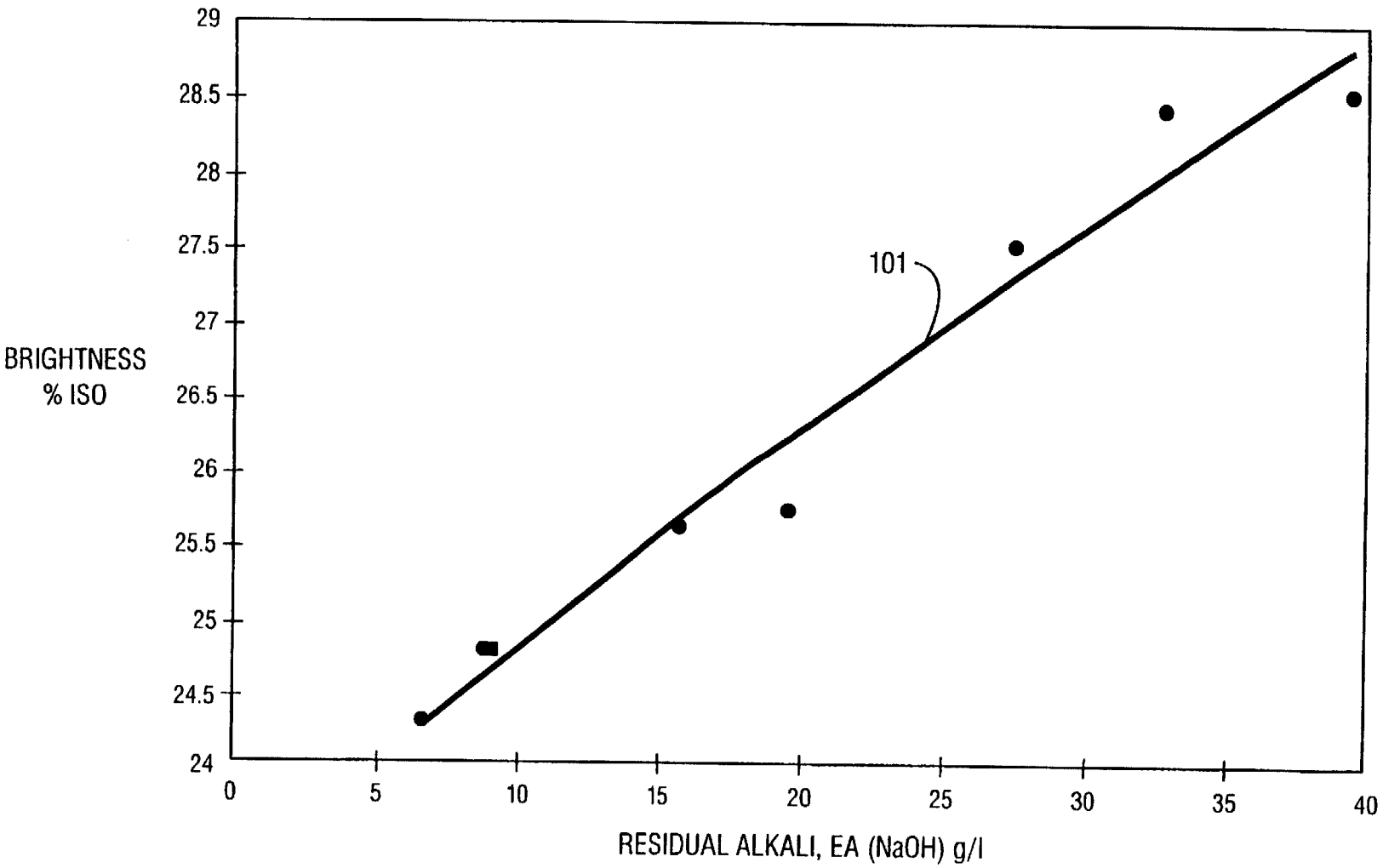
Figure 13:
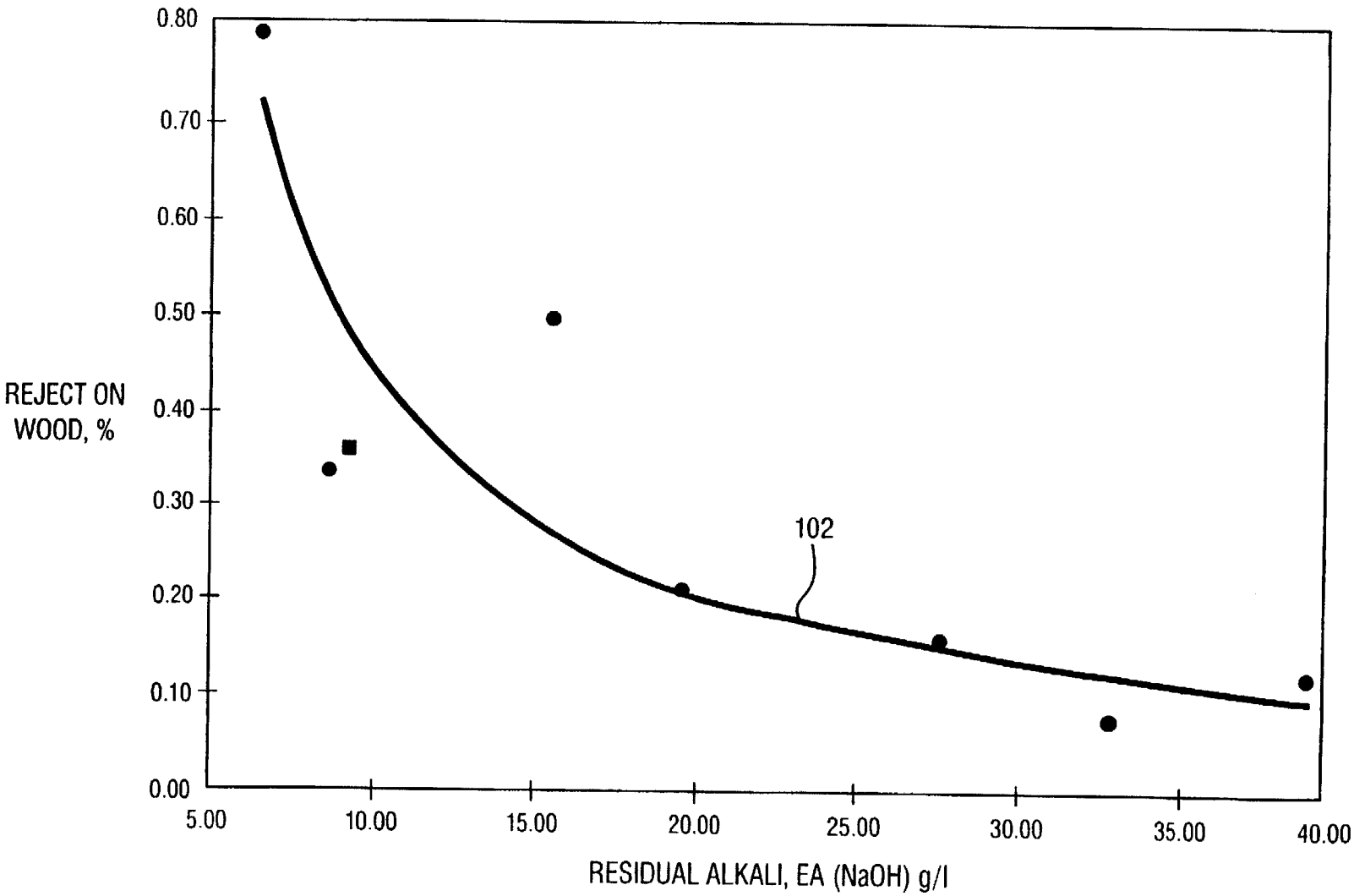

FIGS. 11 through 13 show laboratory test results for pulp produced according to the present invention. The wood chips treated in these lab tests were Scandinavian softwoods under the following conditions: The pretreatment stage was about two hours long at about 100° C., and the EA concentration decreased from about 20 g/l to about 8 g/l. The impregnation stage was about one hour long at about 125° C., and the EA concentration was about 20 g/l. The pretreatment and impregnation stages were similar for all cooks. The cooking stage was about two hours long at different temperatures and EA concentrations to get a target kappa of 25. At the end of the impregnation stage different alkali charges (ranging from 0–27% EA on wood) were introduced to get different EA concentrations at the cooking stage. All lab stages were co-current.

FIG. 11 is a plot 100 of the tear index at 70 Nm/g tensile versus the residual alkali content of the spent cooking liquor at the end of the cook. As the data indicate, with increased residual alkali according to this invention, the tear index, which is an indication of intrinsic fiber strength, increases.

FIG. 12 is a plot 101 of brownstock pulp brightness (ISO) versus residual alkali for the same chips pulp produced for FIG. 11. FIG. 12 shows that the brightness increases as the residual alkali increases which further illustrates the benefits of this invention.

FIG. 13 is a plot 102 of the "rejects" content versus residual alkali for the same pulp used to produce the data of FIGS. 11 and is 12. The term "rejects" refers to the quantity of uncooked wood that is produced and which appears as fines, or small slivers of wood, in the resulting pulp. The fewer rejects that are present, the more complete the pulping process, and the less wood is wasted. As shown, the percentage of rejects declines as the residual alkali left after the cooking process increases.

Figure 14:
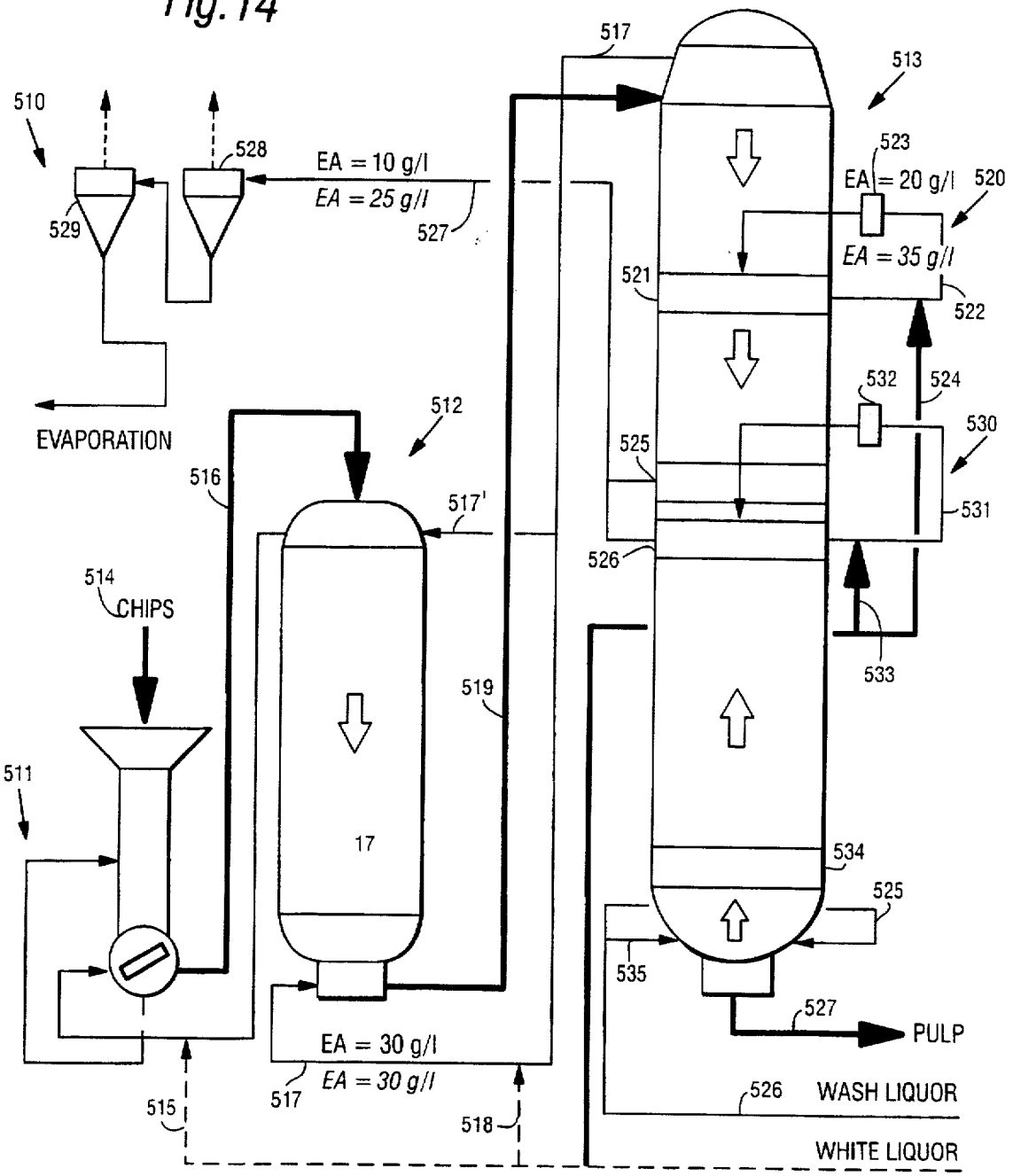
FIG. 14 is a view like that of FIG. 10 only showing another exemplary system according to the invention.

FIG. 14 illustrates another preferred embodiment for practicing the invention and compares it to a conventional mode of operation. The distinction between modes is that white liquor was added to the two cooking circulations in the second mode in addition to the feed system and the BC circulation. This downstream introduction of white liquor increased the EA of the liquor in the first circulation from 20 g/l (as NaOH) to 35 g/l and the EA of the liquor extracted from the digester from 10 g/l to 25 g/l. (All chemical concentration in this specification are expressed as equivalent concentrations of NaOH, unless otherwise specified.) A detailed description of the system of FIG. 14 follows.

The continuous digesting system 510 shown in FIG. 14 comprises a conventional feed system 511, a conventional impregnation vessel (IV) 512, and a continuous vapor-phase digester 513 having two heated liquor circulations 520, and 530. In actual trials performed according to this invention, softwood pine chips 514 were introduced to the feed system 511 in which the chips were steamed, slurried with cooking liquor, via conduit 515, pressurized and passed via conduit 516 to the top of IV 512 at a temperature of about 116°–119° C. The hot slurry of chips and liquor passed co-currently through IV 512 and was discharged from the IV with the aid of liquor introduced via conduit 517. Additional white liquor was added to conduit 517 via conduit 518 such that the EA in conduit 517 and the EA introduced to the chips slurried to the digester in conduit 519 was approximately 30 g/l in both the trial and in the reference mode of operation.

The heated, cooking liquor-laden slurry was introduced to the top of the digester 513 at a temperature of approximately 127°–129° C. Excess liquor was removed from the slurry via a first liquor removal screen (not shown) and passed via conduit 517 back to the bottom of IV 512 to provide the liquor which slurries the chips to digester 513. This recirculation also included a conduit 517' that permits some of the liquor in conduit 517 to be introduced to the upper part of IV 512 to aid in the chip movement and liquor-to-wood ratio at the top to the IV, as is conventional. The slurry introduced to digester 513 then passed co-currently downward to a first circulation 520, referred to as the "trim" circulation, comprising a first liquor removal screen assembly 521, a removal and recirculation conduit 522, and a heater 523. In the reference mode of operation, no fresh cooking liquor was added to this circulation and the EA in this circulation was approximately 20 g/l. In the trials performed according to this invention, white liquor was added to conduit 522 via conduit 524 such that the EA in the circulation 520 during the trial was approximately 35 g/l, that is, about 75% higher than conventional methods.

After passing screen 521, in both modes, the slurry—now heated to cooking temperature at approximately 160°–170° C.—continued to and was heated in the first cooking zone of the digester. The first cooking zone was effectively terminated when the slurry reached a second and third liquor removal screen assembly 525 and 526. Spent cooking liquor was removed from the slurry by screens 525 and 526 and was passed via conduit 527 to conventional flash tanks 528 and 529 to generate steam before being forwarded to chemical and heat recovery.

Associated with screen 526 was a second heated liquor circulation 530, the "quench" circulation, comprising of a recirculation conduit 531 and a heater 532. According to the method of the invention tested, and distinguishing from the reference mode of cooking, additional white liquor was added via conduit 533 to conduit 531. Though the following cooking zone is a counter-current cooking zone, the addition of liquor via conduit 533 and its recirculation to the vicinity of screen 526 ensured that sufficient alkali was present to continue cooking in the counter-current zone.

The system illustrated in FIG. 14 is a schematic of an existing digester system. Since the piping required to effect the desired invention was not available, for example, piping to recirculate alkali-containing spent liquor from conduit 527 to the impregnation vessel 512, the invention was simulated by adding alkali to circulations 520 and 530. This resulted in an alkali concentration in spent liquor stream 527 of about 25 g/l. According to this invention, this relatively high alkali steam, in conduit 527, is preferably introduced, for example, to vessel 512 to replace the EA supplied by the fresh white liquor in conduits 515 and 518; however, during the trials performed this could not be done. However, the effect of having a high alkali content at the end of the cooking zone was evaluated by introducing additional alkali via conduits 524 and 533, which yielded a higher alkali concentration in the spent liquor in conduit 527.

The actual approximate alkali charges used during these trials, expressed as EA on-wood, were 13% to the feed in line 515, 7% to the circulation 517 via line 518 (that is, to the "bottom circulation" or "BC circulation"), 5% to circulation 522 via conduit 524 (that is, to the "trim circulation"), and 5% to circulation 531 via conduit 533 (that is, the "quench circulation"). As a result the total charge on-wood in this trial was approximately 30%. This, of course, is higher than the typical total charge used which is 20%, for example, the 13% and 7% used in the baseline tests of this trial. However, in implementing the present invention, the actual alkali charged to the entire process, in the most desired case the alkali is added at the later stages of cooking, is about 20%, that is between 18–22%, as is conventional. However, by introducing such a relatively high alkali concentration and thus a high pH at the end of the cook, a spent liquor having a relatively high alkali concentration and pH is produced. This high-alkali spent liquor is preferably used in the earlier cooking stages as a source of alkali. Thus, according to the this invention, by reusing the high-alkali spent liquor, the cellulose is effectively exposed to an EA on-wood of greater than 20%, typically greater than 25%, or even greater than 30%, while not introducing fresh cooking liquor in an amount greater than is conventional, that is about 20% on wood. As an alternative, by reusing some of the EA charged to the latter stages of the cook, less fresh cooking liquor may be introduced to the system while maintaining the same degree of cooking. That is, the pulp mill can obtain a saving in chemical use and cost by implementing this invention.

After passing screen 526 the slurry entered a counter-current cooking/washing zone, that is, a Hi-Heat™ wash zone, available from Ahlstrom Machinery Inc. of Glens Falls, N.Y., in the lower part of the digester 513. Though the principal treatment in this zone was a counter-current displacement of cooking liquor with wash liquor, due to the introduction of cooking liquor to circulation 530, thus effecting EMCC® cooking as marketed by Ahlstrom Machinery Inc., some additional cooking occurred in this zone. The Hi-Heat zone was effectively terminated when the cooked slurry reached screen assembly 534. The filtrate 526 that was used in the counter-current wash zone was introduced via nozzles 535 in the bottom head of the digester. The pulp, referred to as brownstock pulp, was discharged into conduit 527. The pulp was subsequently bleached using an O-O-DO-E-D1-D2 bleaching sequence.

Though it is preferred that at least some alkali is introduced to the final counter-current cooking/washing zone to maintain the desired alkalinity and pH, sometimes the inefficiencies of the treatment may make alkali addition unnecessary. Ideally, all the alkali entering the counter-current zone will be extracted from the chips into the liquor and be removed via screen 526. However, due to non-uniform displacement or diffusion of the alkali from the chips, some alkali and temperature may remain in the down-flowing chip mass. This alkali and temperature may be sufficient to provide the desired alkalinity and pH of the present invention. Such was the case in the digester in which these trial were performed. Though no alkali was added in the vicinity of screen 534, sufficient alkali and temperature (about 130° C.) remained in the chip mass so that the desired alkalinity and pH were present in the counter-current cooking/washing zone.

In a trial of the system of FIG. 14 the wash circulation (not shown) associated with screen 534, was on, but the flow rate was very low.

Figure 15:
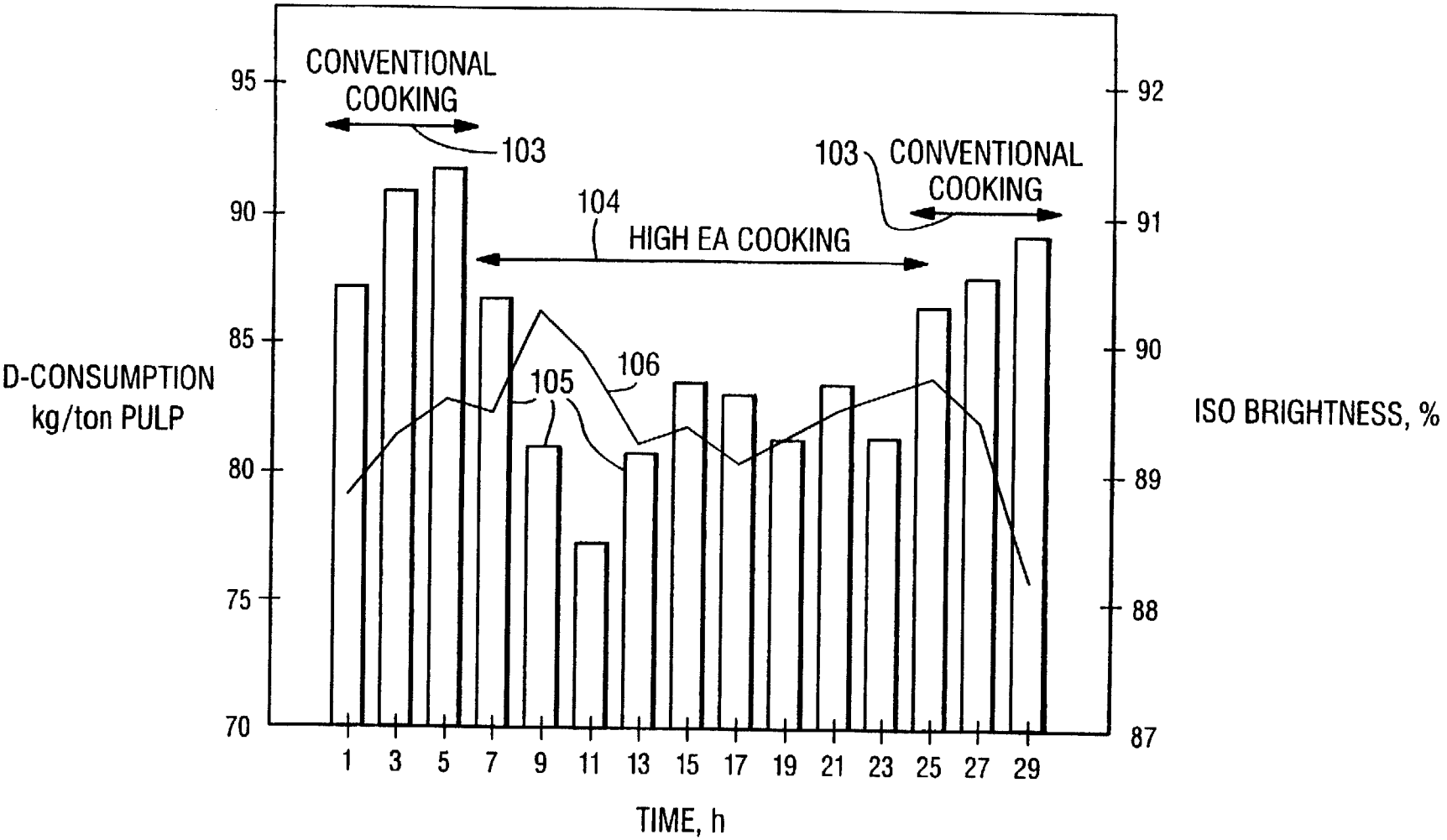
FIGS. 15 through 17 are graphical representations showing the effect of high effective alkali concentration in actual trials run utilizing the system of FIG. 14.
Figure 16:
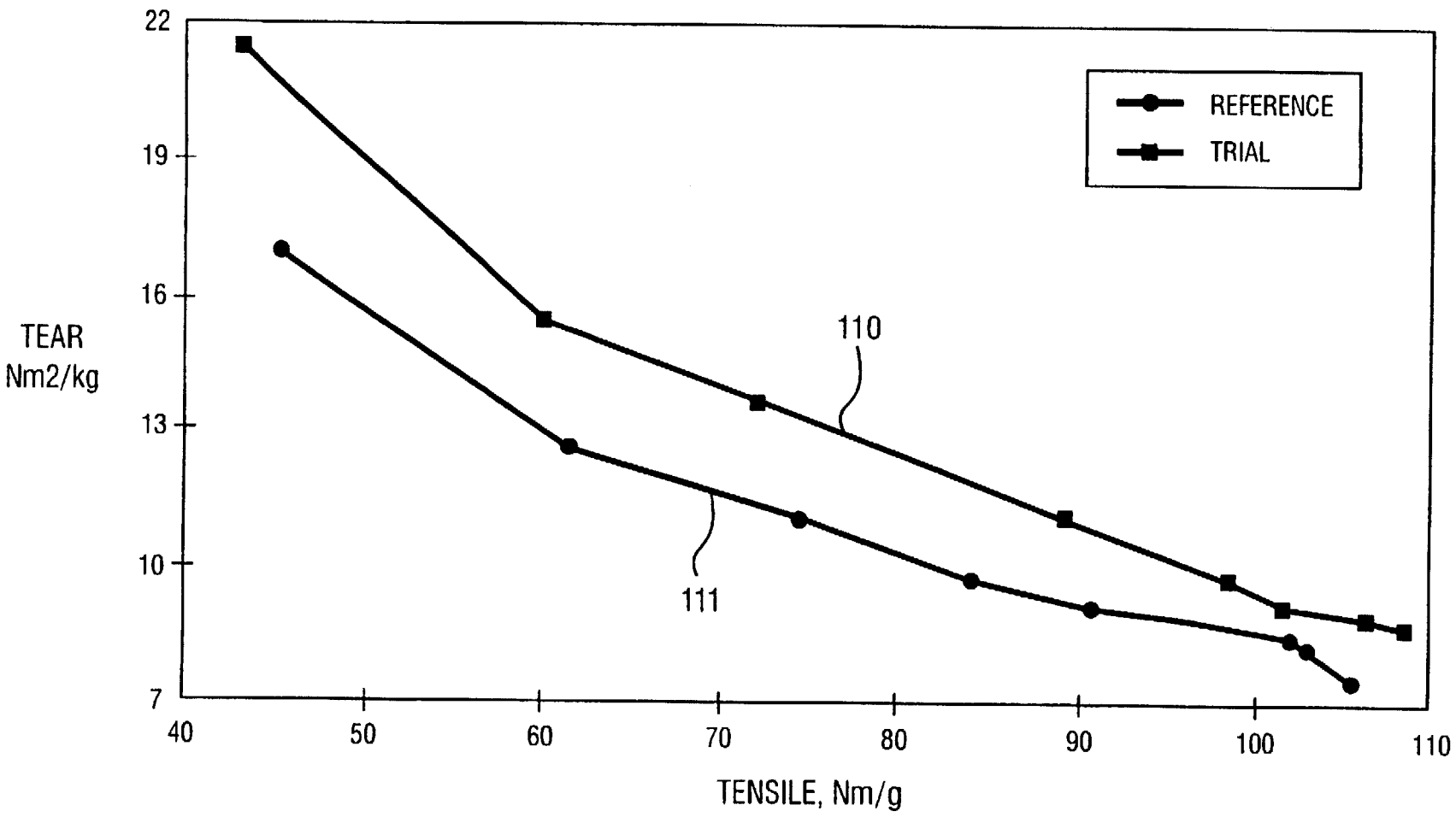
Figure 17:
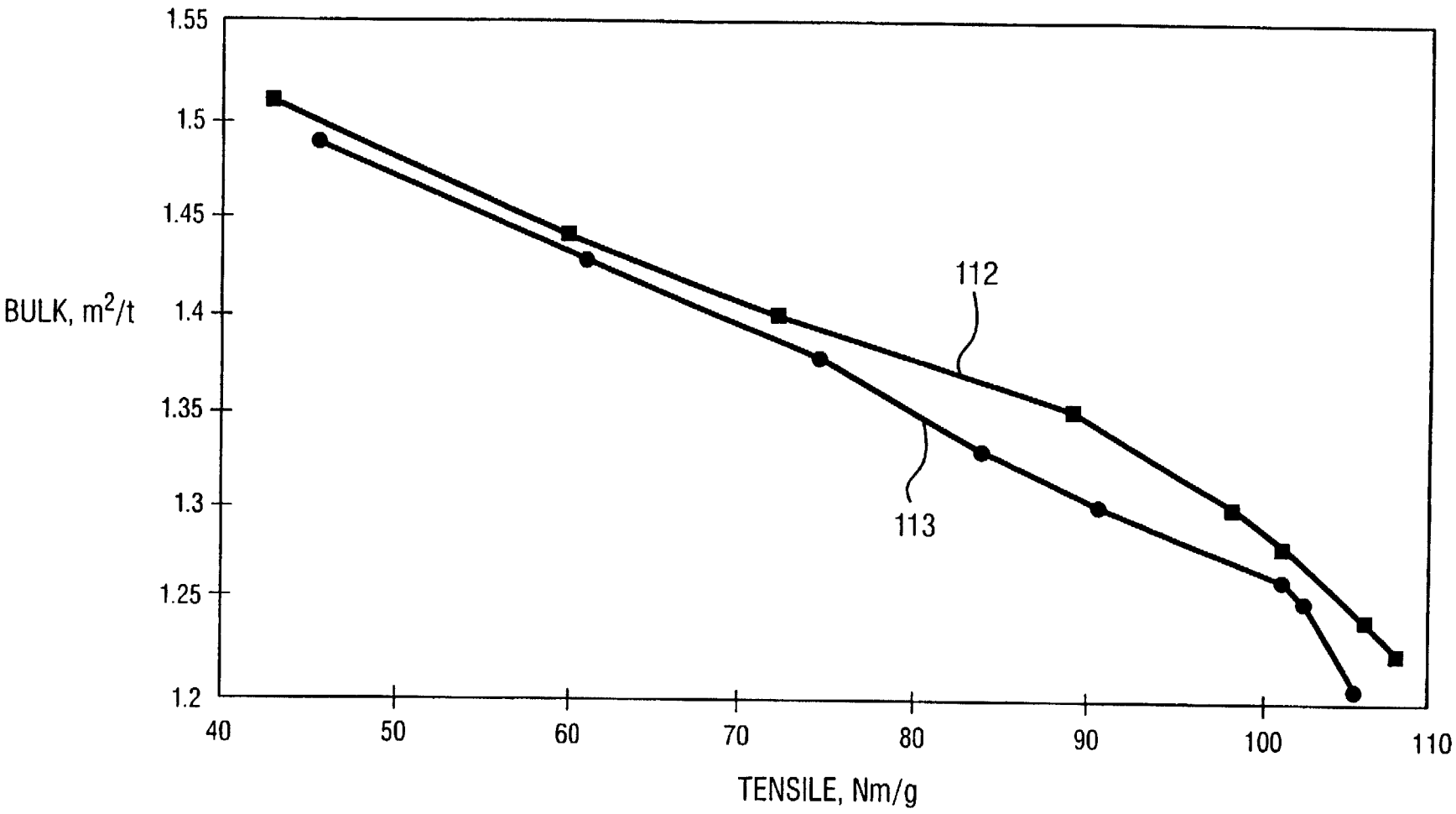

A comparison of the results achieved in the reference mode of operation and the mode of operation of the invention (FIG. 14) on softwood appears in FIGS. 15, 16, and 17. The production rate during the trial was approximately 600 air-dry metric tons per day (ADMT/D). The kappa number during the trial was relatively well controlled between a value of 24 and 30. In order to obtain this kappa number with the new distribution of cooking chemical, the cooking temperature compared to the reference mode was decreased by 5° C.

FIG. 15 illustrates the variation of bleaching chemical consumption and final bleached-pulp brightness during the trial period. (Outside this period hardwood birch chips were treated; hardwoods typically have a lower bleaching chemical demand, that is, a higher "bleachability," than softwoods.) The abscissa defines the hours of operation; the left-hand ordinate, total relative consumption of chlorine dioxide (D); and the right ordinate, the final bleached pulp brightness in ISO units. Conventional cooking took place during hours 103 on either side of the trial (High EA cooking) 104. The chlorine dioxide consumption is indicated by the vertical bars 105, the final brightness is indicated by the solid line 106. As shown, the chorine dioxide consumption clearly declines after the trial is initiated at about hour seven. Also shown is the clear increase in final brightness since the bleach chemical addition control is delayed in reacting to the reduced bleaching chemical demand of the trial-cooked pulp, as is typical. However, when the brightness is stabilized, the chlorine dioxide consumption is approximately 9% lower than the reference treatment of softwood pine. This is true even though the kappa numbers (not shown) during the trial period were higher than those of the reference cooking treatment.

FIG. 16 illustrates the increased bleached pulp strength of the provided by the present invention 110 in comparison to the reference cooking mode 111. The abscissa of FIG. 16 is tensile strength of the paper in Nm/g. The ordinate is tear strength in $Nm^2/kg$. This plot clearly shows that the tear strength of the paper produced by the process of this invention 110 is greater than the tear strength of the reference pulp. For example, at a tensile strength 90 Nm/g, the tear of the pulp produced by this invention is approximately 20% greater than the reference pulp.

FIG. 17 compares the bleached "bulk", or dry specific volume, of the paper produced from the pulp made by the two processes as a function of tensile strength. The "bulk" of a sheet of paper is the ratio of the sheets thickness to its weight per unit area which is expressed as a unit of volume per weight, and in this case cubic meter per ton ($m^3/t$). Bulk indicates the density of a sheet of paper; a low bulk corresponds to high density. FIG. 17 shows that paper produced by the process of this invention 112 has approximately a 5% higher bulk than the reference 113 for a given tensile strength. This means that fine paper produced by this invention can for some situations have a decreased weight (grams of pulp per square meter of paper) and still have the same qualities.

It will thus be seen that the high alkali pulping process disclosed in this application can be readily integrated into several existing systems to provide novel processes for producing a chemical cellulose pulp that is stronger than pulps produced by the conventional art. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to cover all equivalent processes, products, and systems.

What is claimed is:

1. A method of producing chemical cellulose pulp from comminuted cellulose fibrous material using a continuous digester having an inlet, comprising the steps of:

(a) continuously feeding comminuted cellulose fibrous material in a liquid slurry to the inlet to the continuous digester; and (b) cooking the material in the digester for more than thirty minutes at a temperature between about 140°–190° C., before the cook is terminated; and wherein step (b) is practiced so that during at least the last minute before the cook is terminated the effective alkali concentration, expressed as NaOH or equivalent, in the digester is between 20–50g/l.

2. A method as recited in claim 1 wherein step (b) is practiced so that during at least the last 15 minutes before the cook is terminated the effective alkali concentration is between about 21–35 g/l.

3. A method as recited in claim 1 wherein step (b) is practiced so that during at least the last 30 minutes before the cook is terminated the effective alkali concentration is between about 25–35 g/l.

4. A method as recited in claim 1 wherein step (b) is practiced by: at least at first and second locations removing liquid from the slurry, the first location being closest to the digester inlet; and adding fresh alkali; and wherein more than 50% of the total alkali added to the slurry during the entire practice of steps (a) and (b) is added after the first location.

5. A method as recited in claim 4 wherein said step of adding alkali after the first location is practiced at more than two different locations, and added so that the highest effective alkali concentration during the practice of step (b) is less than 35 g/l.

6. A method as recited in claim 4 wherein step (b) is practiced in at least two different stages, a first stage closer to the digester inlet, and a second stage further from the digester inlet; and wherein said second stage is a countercurrent cooking stage.

7. A method as recited in claim 1 wherein step (b) is practiced by: at least at first and second locations removing liquid from the slurry, the first location being closest to the digester inlet; and adding fresh alkali; and wherein more than 70% of the total alkali added to the slurry during the entire practice of steps (a) and (b) is added after the first location.

8. A method as recited in claim 7 wherein said step of adding alkali after the first location is practiced so that the highest effective alkali concentration during the practice of step (b) is less than 35 g/l.

9. A method as recited in claim 8 wherein after an alkali addition after the first location at least 7% on wood of effective alkali is consumed by the cellulose material.

10. A method as recited in claim 1 wherein step (b) is practiced by: at least at first and second locations removing liquid from the slurry, the first location being closest to the digester inlet; and adding alkali; and wherein more than 80% of the total fresh alkali added to the slurry during the entire practice of steps (a) and (b) is added after the first location.

11. A method as recited in claim 10 wherein said step of adding alkali after the first location is practiced at more than two different locations, and added so that the highest effective alkali concentration during the practice of step (b) is less than 35 g/l.

12. A method as recited in claim 11 wherein after an alkali addition after the first location at least 9% on wood of effective alkali is consumed by the cellulose material.

13. A method as recited in claim 1 wherein step (b) is practiced in at least two different stages, a first stage closer to the digester inlet, and a second stage further from the digester inlet; and wherein said second stage is a counter-current cooking stage.

14. A method as recited in claim 13 wherein the second cooking stage is the last cooking stage, and is counter-current, and wherein during the last minute before the cook is terminated in the second, counter-current, cooking stage the effective alkali concentration expressed as NaOH or equivalent is between 20–35 g/l.

15. A method as recited in claim 1 comprising the further step of subjecting the material to a counter-current wash to substantially terminate the cook before discharge of the material from the continuous digester.

16. A method of producing chemical pulp having enhanced intrinsic fiber strength from comminuted cellulosic fibrous material, comprising the steps of continuously and sequentially:

(a) treating the comminuted cellulosic fibrous material with a first cooking liquor having a first effective alkali concentration which is greater than 10 g/l;

(b) further treating the material with the first cooking liquor so as to consume alkali from the first cooking liquor, so that the effective alkali concentration of the spent first liquor is reduced to about 10 g/l or less;

(c) extracting the spent first cooking liquor from the material;

(d) treating the material with a second cooking liquor having a second effective alkali concentration greater than about 25 g/l and greater than the first concentration, the second cooking liquor providing at least 50% of the total fresh alkali to be consumed by the material in the production of chemical pulp;

(e) cooking the material with the second cooking liquor at cooking temperature to produce chemical pulp and a spent second cooking liquor having an effective alkali concentration expressed as NaOH or equivalent of greater than about 20 g/l; and (f) extracting the spent second cooking liquor from the pulp in the digester; and wherein step (e) is practiced for more than 30 minutes, and wherein during at least the last fifteen minutes the effective alkali concentration expressed as NaOH or equivalent is between 20–40 g/l, so as to produce chemical pulp having enhanced intrinsic fiber strength compared to if the effective alkali concentration was below 15 g/l during the last fifteen minutes of step (e).

17. A method as recited in claim 16 wherein during at least the last fifteen minutes the effective alkali concentration is between 25–35 g/l.

18. A method as recited in claim 17 wherein about 80% or more of the total amount of white liquor and total fresh alkali to be used to produce the pulp is added in step (d) as the second cooking liquor.

19. A method as recited in claim 17 wherein steps (d) and (e) are practiced in a counter-current cooking stage.

20. A method as recited in claim 16 wherein steps (d) and (e) are practiced in a counter-current cooking stage.

21. A method as recited in claim 16 wherein step (b) is practiced to consume at least 7% on wood of effective alkali.

* * * * *